US010670015B2

(12) United States Patent
Iwai et al.

(10) Patent No.: US 10,670,015 B2
(45) Date of Patent: Jun. 2, 2020

(54) SCREW COMPRESSOR

(71) Applicant: Johnson Controls-Hitachi Air Conditioning Technology (Hong Kong) Limited, Hong Kong (CN)

(72) Inventors: Satoshi Iwai, Tokyo (JP); Ryuichiro Yonemoto, Tokyo (JP); Eisuke Kato, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 320 days.

(21) Appl. No.: 15/553,604

(22) PCT Filed: Oct. 28, 2015

(86) PCT No.: PCT/JP2015/080340
§ 371 (c)(1),
(2) Date: Aug. 25, 2017

(87) PCT Pub. No.: WO2016/136028
PCT Pub. Date: Sep. 1, 2016

(65) Prior Publication Data

US 2018/0045200 A1 Feb. 15, 2018

(30) Foreign Application Priority Data

Feb. 26, 2015 (JP) ..... 2015-037132

(51) Int. Cl.
*F04C 18/16* (2006.01)
*F04C 29/02* (2006.01)
(Continued)

(52) U.S. Cl.
CPC ..... *F04C 18/16* (2013.01); *F04C 28/24* (2013.01); *F04C 29/021* (2013.01);
(Continued)

(58) Field of Classification Search
CPC ..... F04C 18/16; F04C 29/021; F04C 28/24; F04C 29/028; F25B 2600/0262
(Continued)

(56) References Cited

U.S. PATENT DOCUMENTS 4,211,522 A * 7/1980 Pidgeon ..... F01M 11/04 418/99
2005/0257542 A1* 11/2005 von Borstel ..... F04C 29/021 62/192
2012/0207634 A1 8/2012 Heger et al.

FOREIGN PATENT DOCUMENTS

JP 5-133359 5/1993
JP 2013-217283 10/2013
JP 2014-118931 6/2014

OTHER PUBLICATIONS

International Search Report for PCT/JP2015/080340 dated Feb. 2, 2016.

* cited by examiner

*Primary Examiner* — Deming Wan
(74) *Attorney, Agent, or Firm* — Mattingly & Malur, PC

(57) ABSTRACT

A screw compressor includes a screw rotor, an electric motor for driving the screw rotor, bearings supporting the screw rotor and casings housing these members. The screw compressor also includes an oil feeding passage formed in the casing for feeding oil on a high pressure side to the bearings by a differential pressure between the high pressure side and a low pressure side and an oil feeding amount adjusting unit placed in a middle of the oil feeding passage, the oil feeding amount adjusting unit includes a cylinder, a valve element provided to reciprocate inside the cylinder, and plural flow paths provided in the valve element having different flow path areas, the plural flow paths are switched to adjust an oil feeding amount to be fed to the bearings by moving the
(Continued)

valve element in accordance with the differential pressure between the high pressure side and the low pressure side.

14 Claims, 10 Drawing Sheets

(51) Int. Cl.
*F04C 28/24* (2006.01)
*F04C 23/00* (2006.01)

(52) U.S. Cl.
CPC ..... *F04C 23/008* (2013.01); *F04C 2240/30* (2013.01); *F04C 2240/40* (2013.01); *F04C 2240/50* (2013.01); *F04C 2240/81* (2013.01); *F04C 2270/21* (2013.01)

(58) Field of Classification Search
USPC ..... 418/98, 206.7, 206.8
See application file for complete search history.

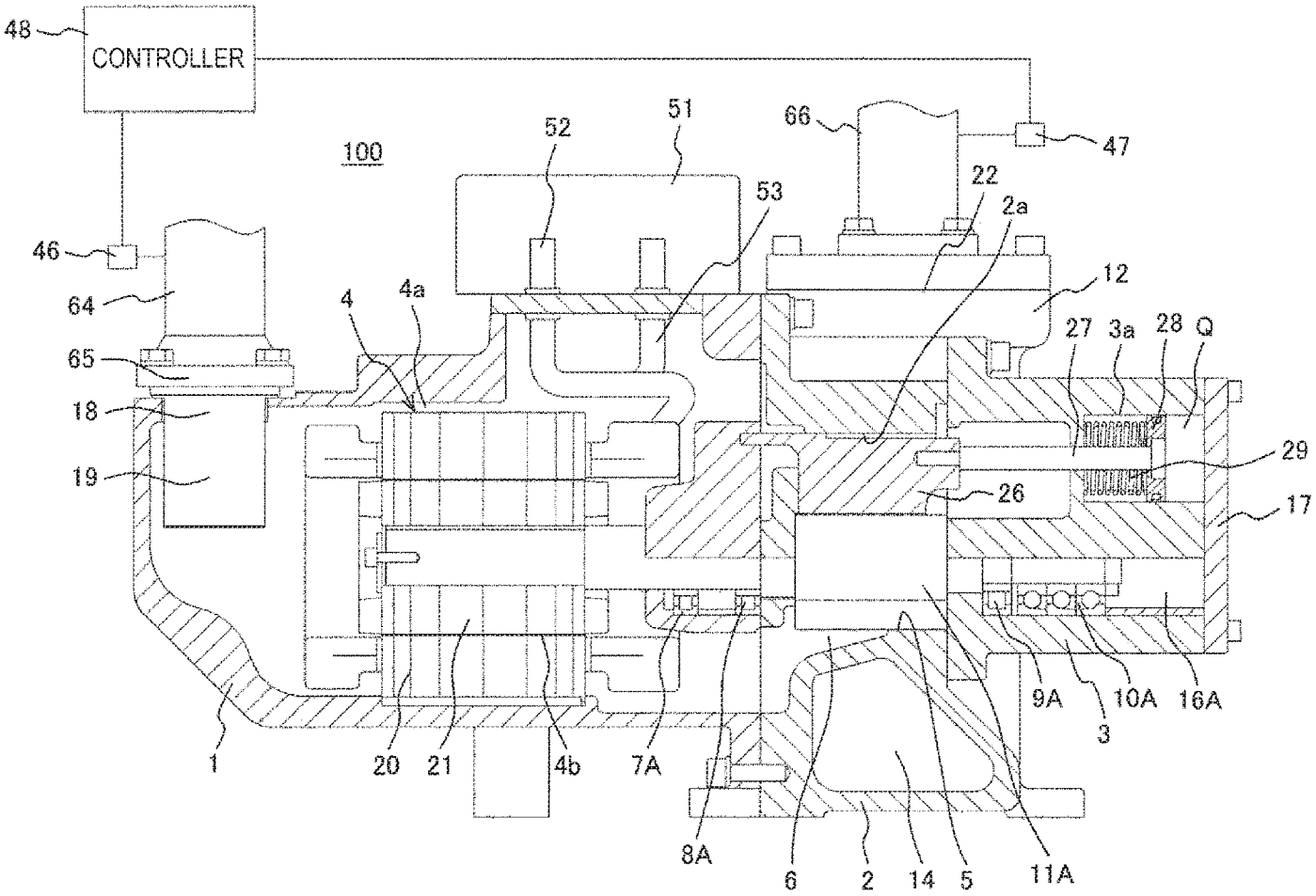
[FIG. 1]

[FIG. 2]
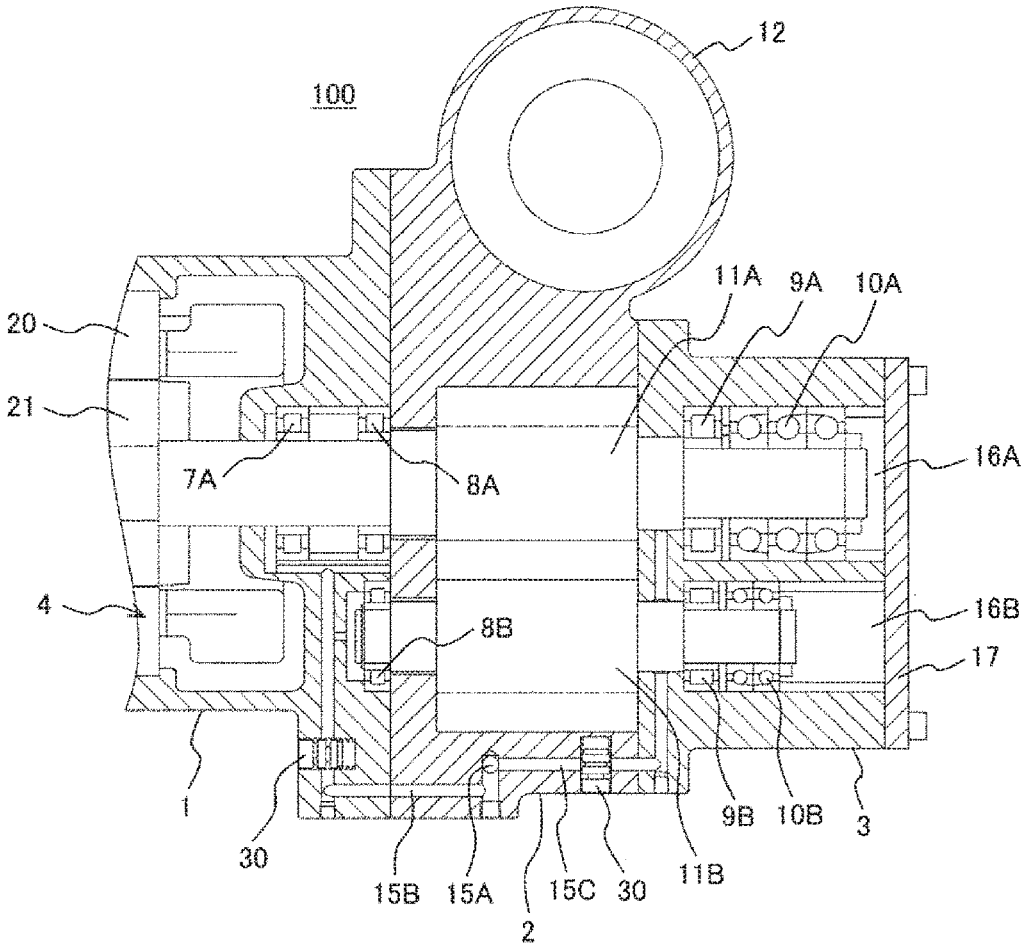

[FIG. 3]
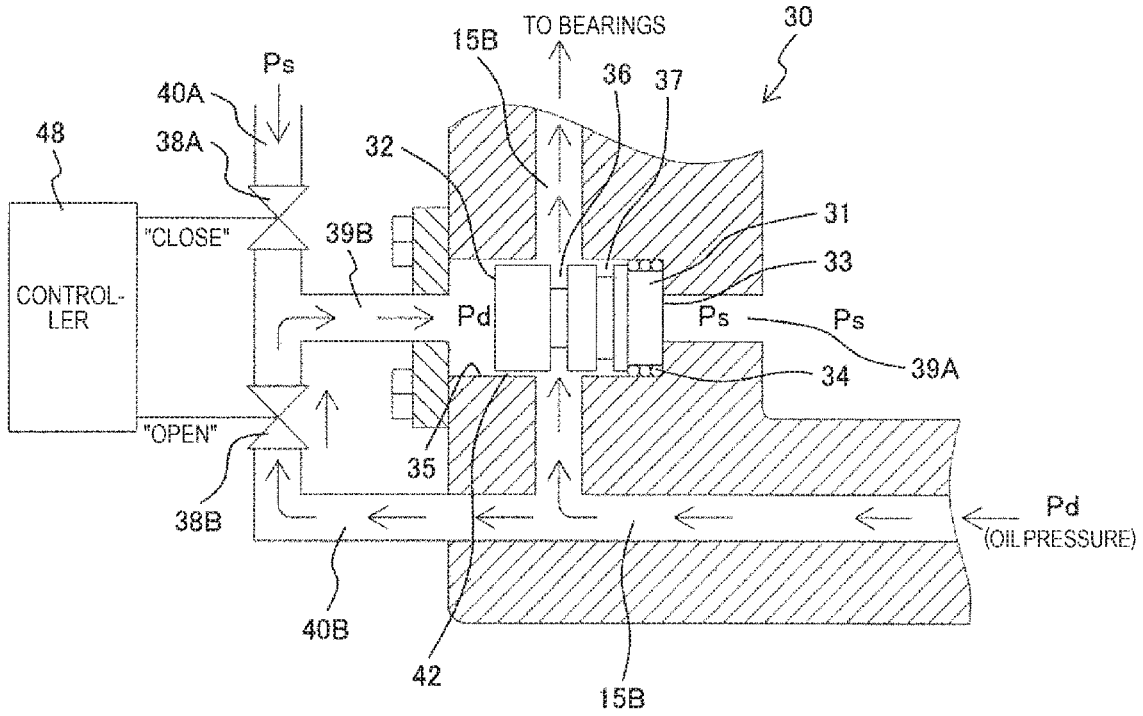
[FIG. 4]
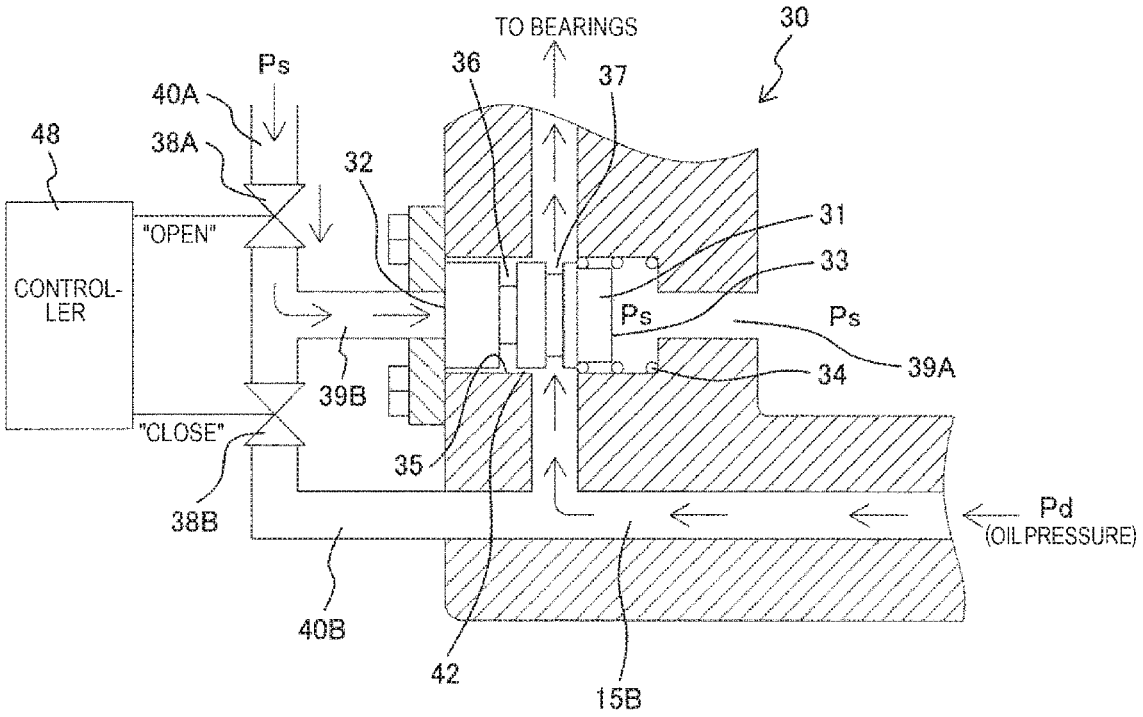

[FIG. 5]
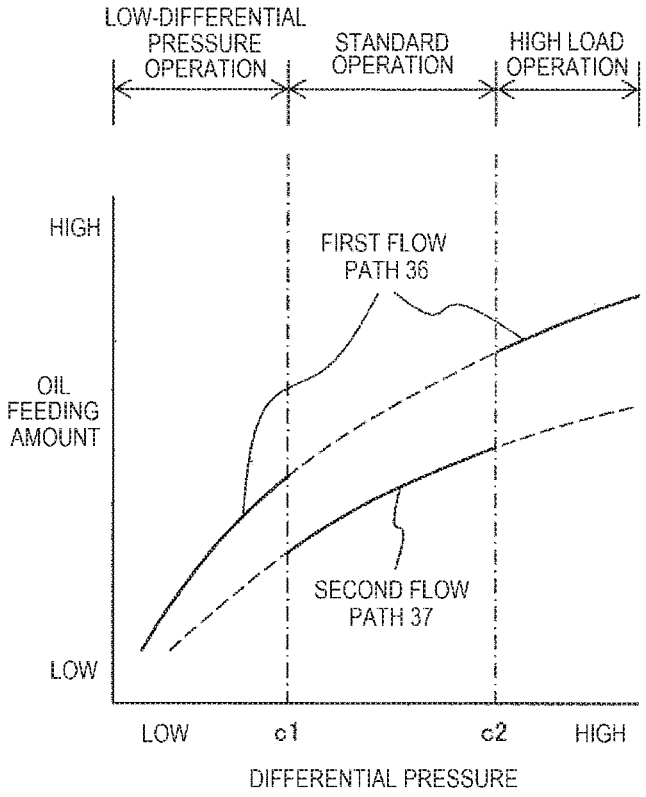
[FIG. 6]
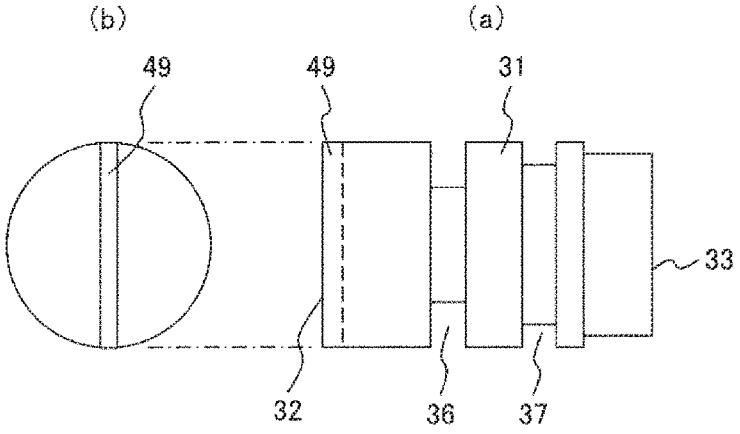

[FIG. 7]
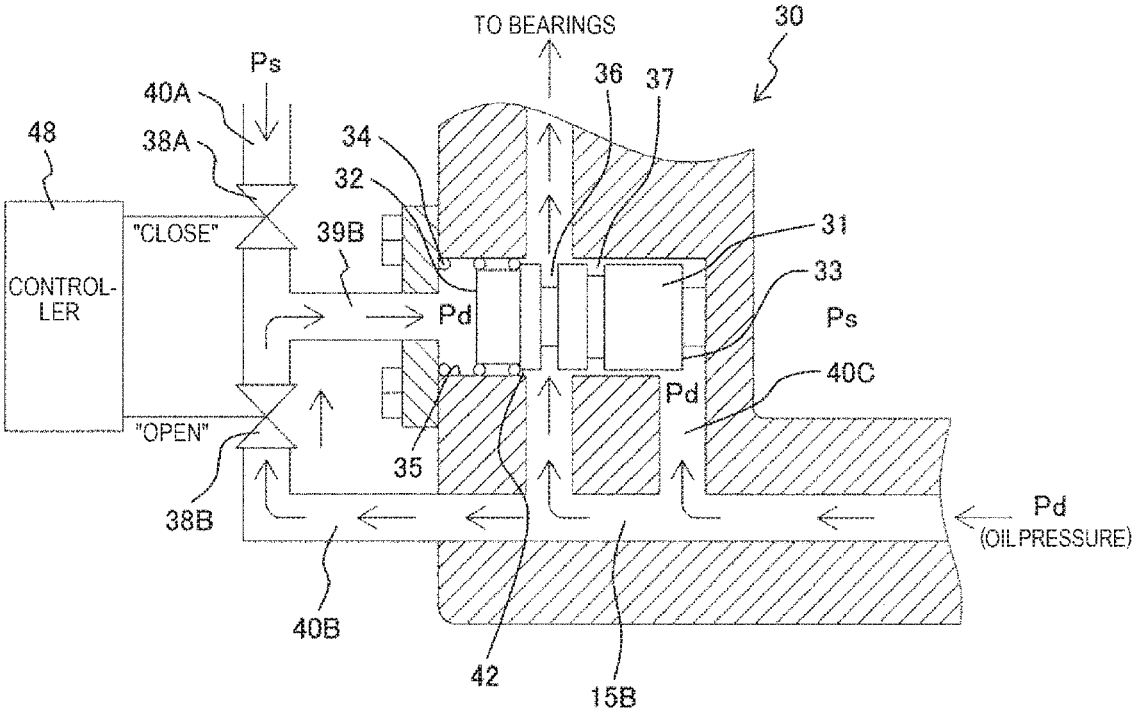
[FIG. 8]
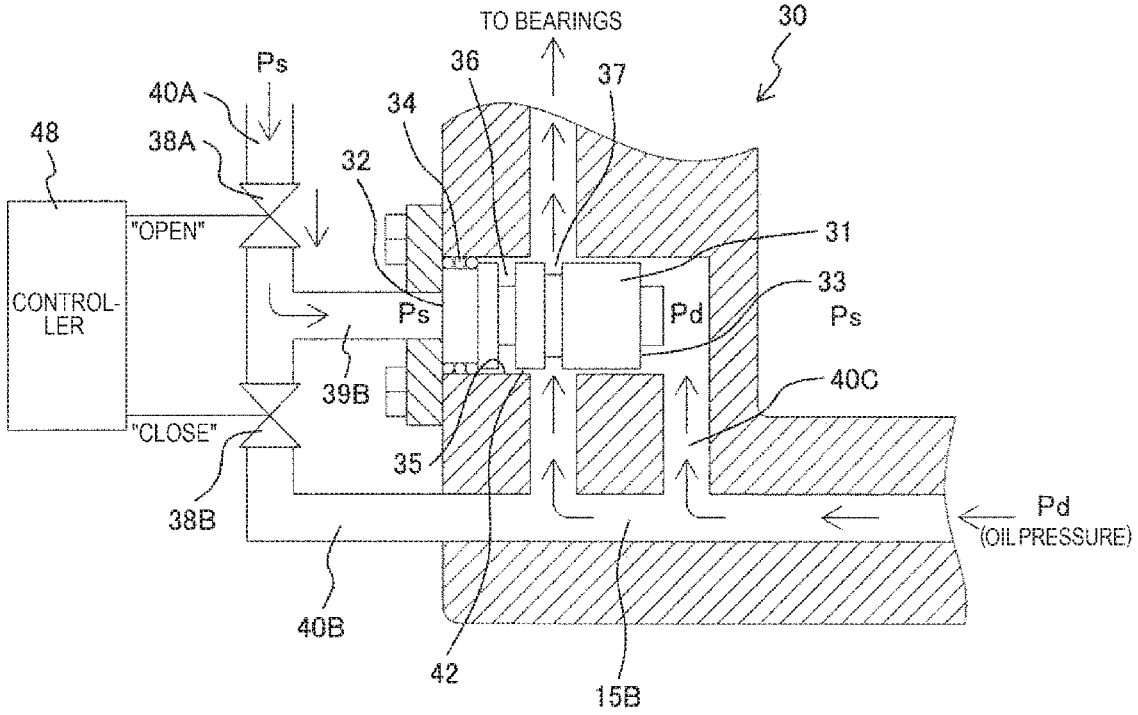

[FIG. 9]
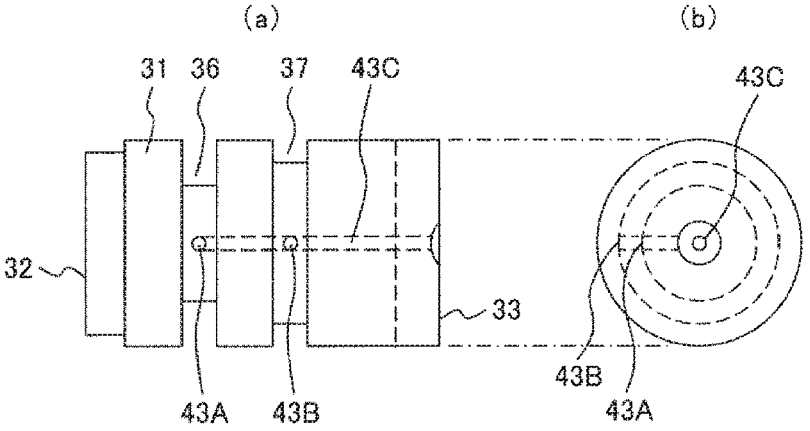
[FIG. 10]
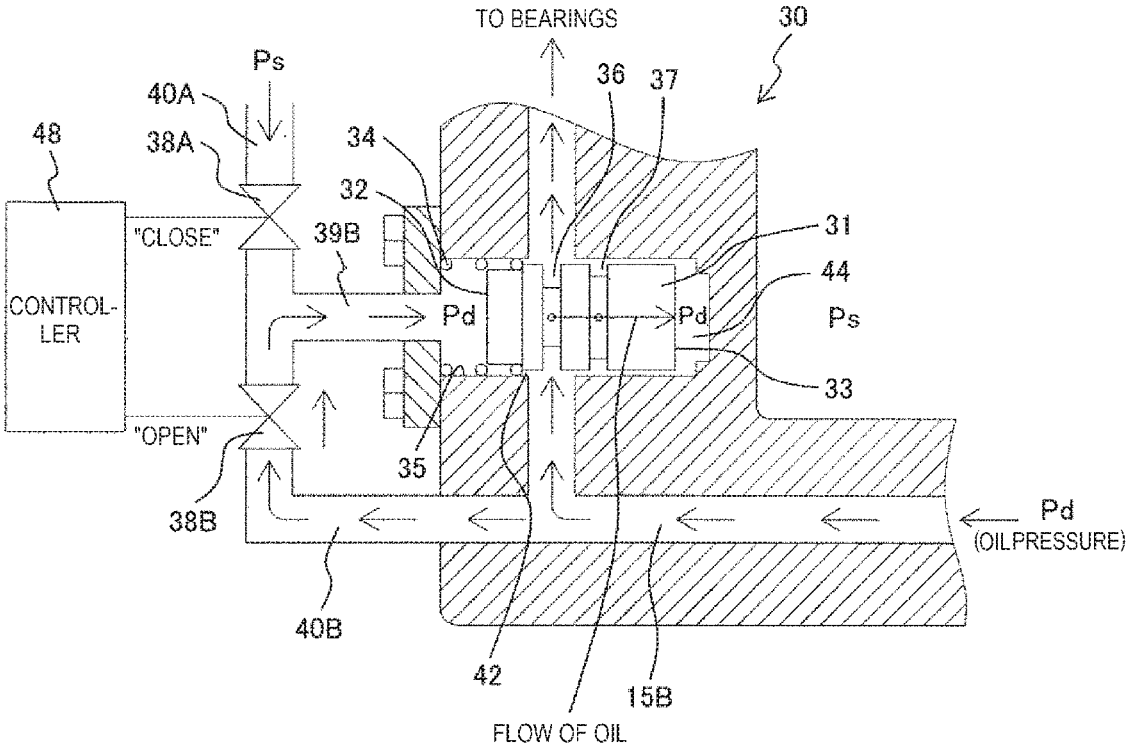

[FIG. 11]
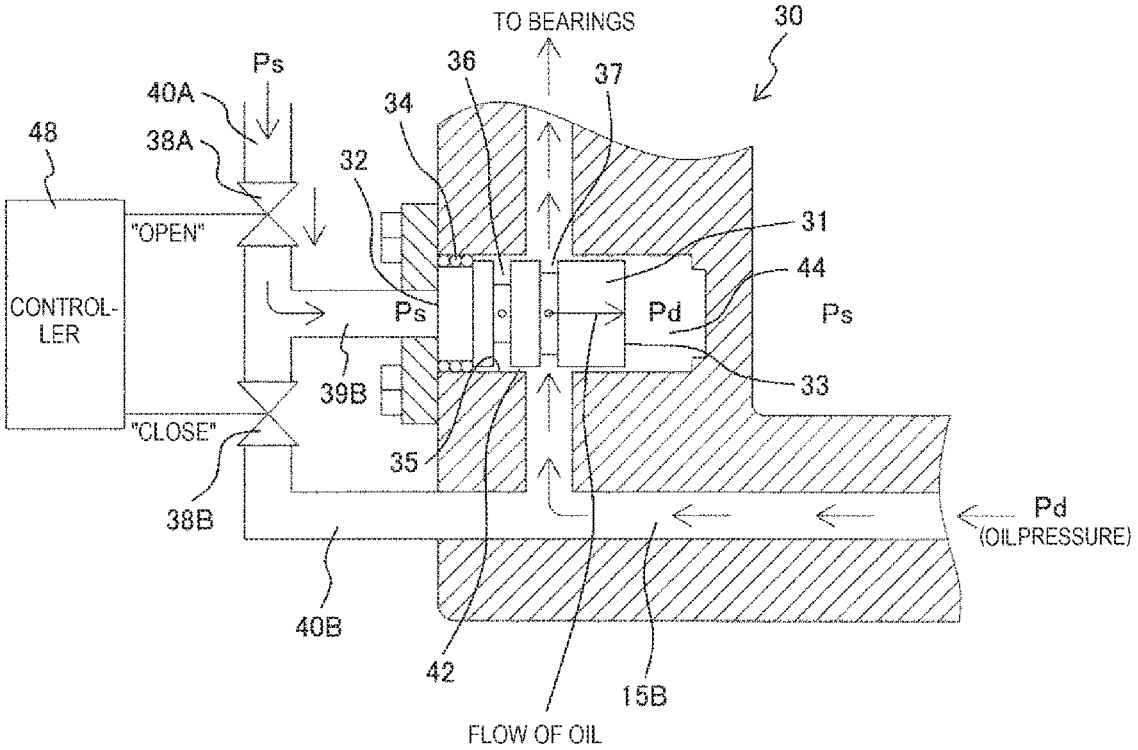
[FIG. 12]
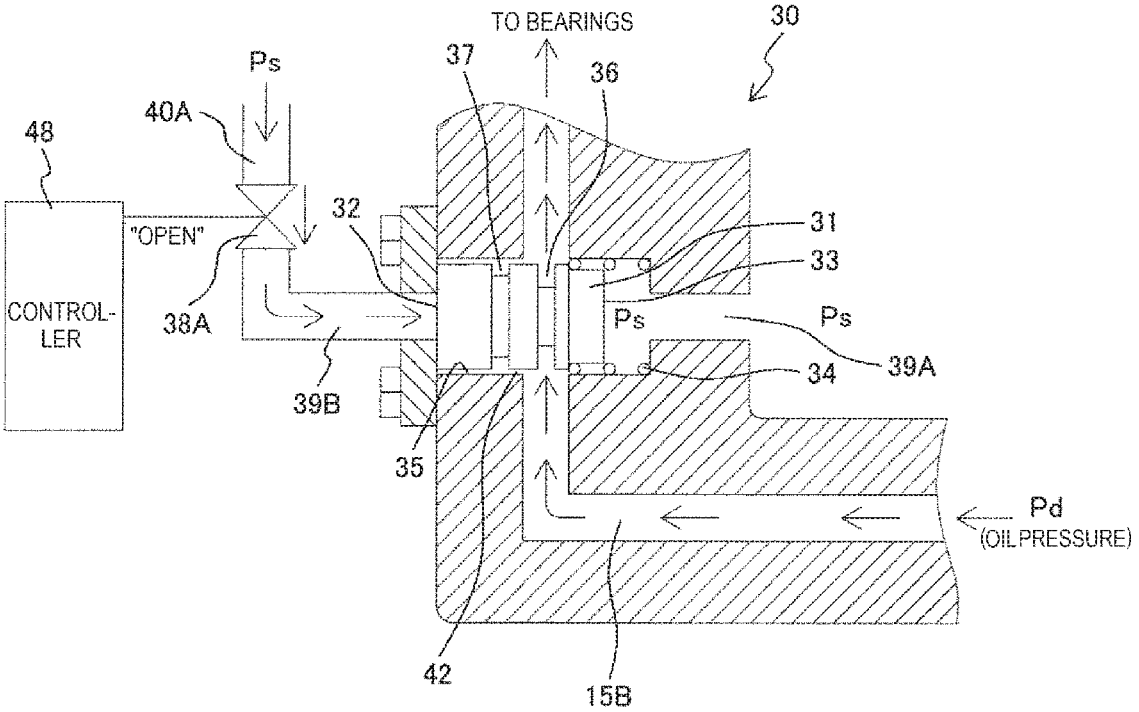

[FIG. 13]
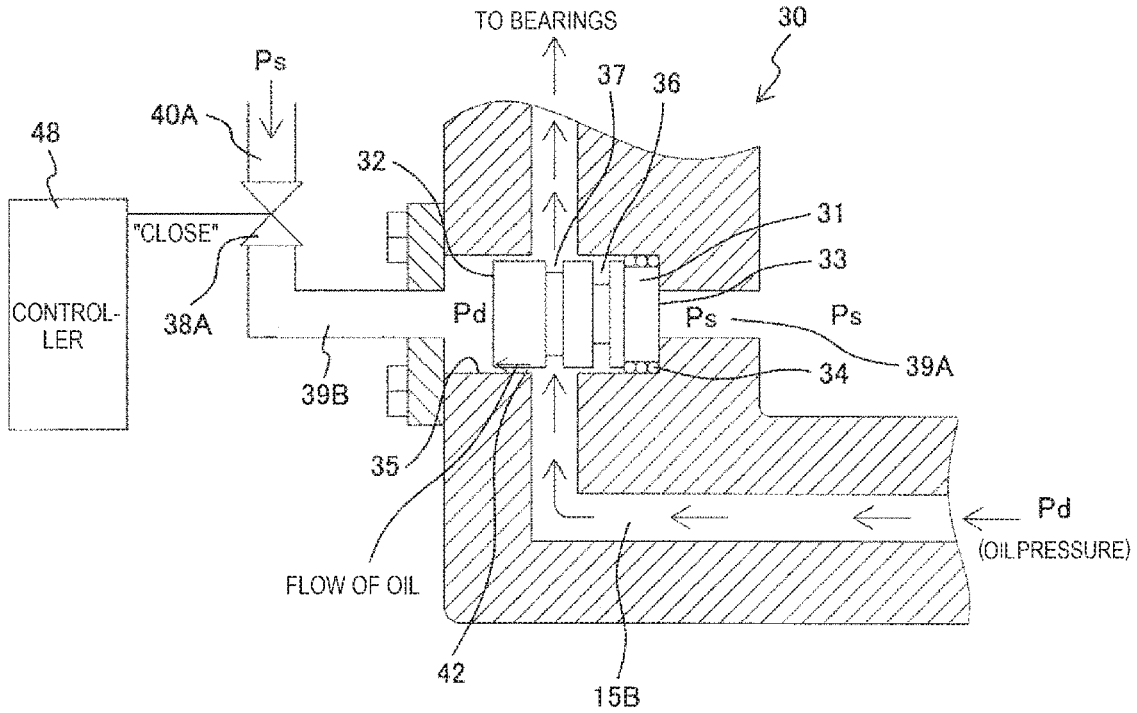
[FIG. 14]
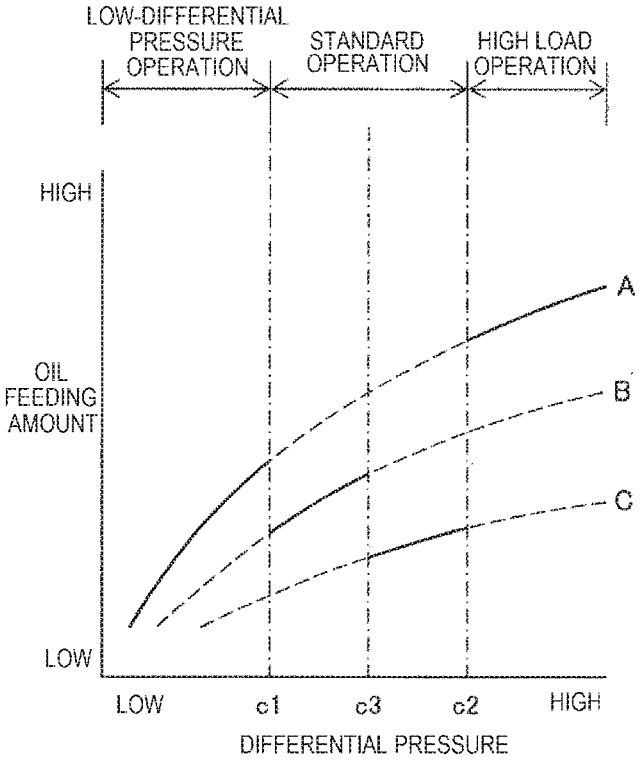

[FIG. 15]
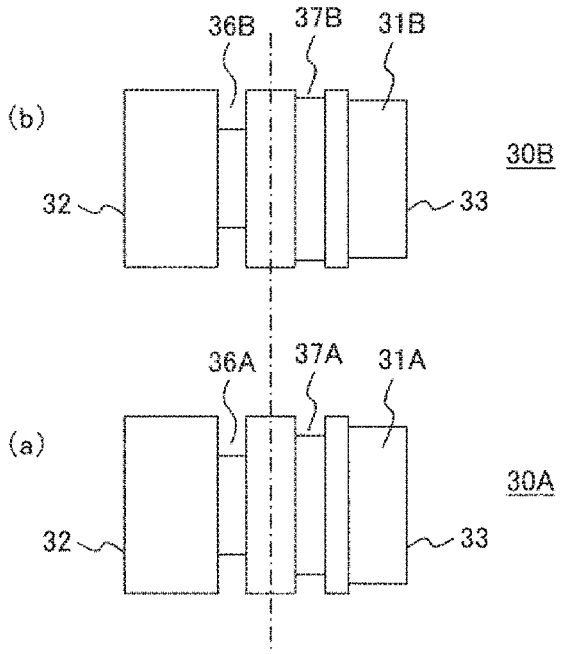
[FIG. 16]
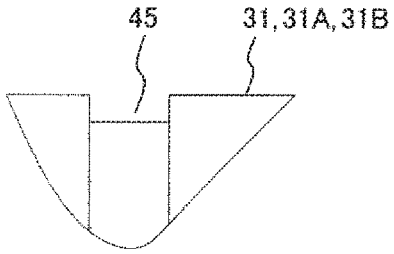
[FIG. 17]
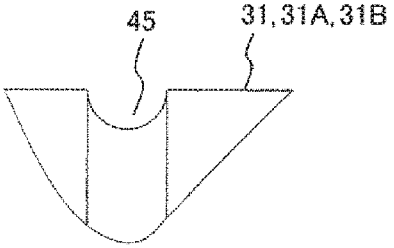

[FIG. 18]
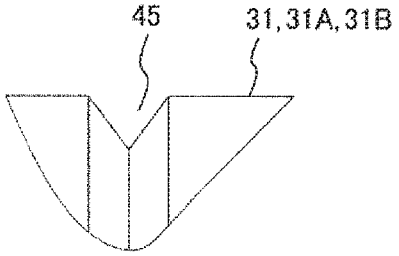

SCREW COMPRESSOR

TECHNICAL FIELD

The present invention relates to a screw compressor, and particularly relates to a hermetic or semi-hermetic screw compressor used for an air conditioner, a chiller unit, a refrigerator and the like.

BACKGROUND ART

The screw compressor includes, for example, a pair of screw rotors of a male rotor and a female rotor which are engaged with each other. The male rotor and the female rotor are rotatably supported by roller bearings and ball bearings, respectively.

Each of the rolling bearing and the ball bearing has a rolling surface or a sliding surface. It is necessary to form thin oil films on these surfaces to prevent direct contact between metals, therefore, oil lubrication is required. As advantages of oil lubrication, discharge of frictional heat, extension of a bearing lifetime, prevention of rust, prevention of foreign matter intrusion and so on can be cited in addition to reduction of friction and abrasion.

As the screw rotor rotates at high speed, frictional heat is generated at respective bearing portions. Accordingly, a force fed lubrication system in which respective bearings are lubricated by forcibly feeding lubricating oil into the bearings and generated frictional heat is discharged to the outside through the forcibly fed lubricating oil in respective bearings is adopted.

That is, oil passages communicating with respective bearings are provided in a casing or the like of the screw compressor to perform the forced lubrication in which lubrication oil is forcibly fed to respective bearings through the oil passages by utilizing a differential pressure between a discharge-side pressure and a suction-side pressure of the screw compressor.

As this kind of related art, there are one described in JP-A-2014-118931 (Patent Literature 1) and so on.

CITATION LIST

Patent Literature

Patent Literature 1: JP-A-2014-118931

SUMMARY OF INVENTION

Technical Problem

Part of lubricating oil (hereinafter also referred to merely as oil) forcibly fed to the bearings flows into a compression chamber formed of the screw rotor with a suction gas to the screw compressor to perform lubrication and sealing of the screw rotor, cooling of compression heat and so on. The amount of oil fed to the bearings is regulated to a suitable amount, thereby suppressing the heating of the suction gas by oil and loss of oil by agitation, contributing to improvement in performance of the compressor.

Generally, in the related-art force fed lubrication system using the differential pressure, an oil restrictor (orifice) is provided in an oil feeding path to adjust an oil feeding amount by the size of the oil restrictor. However, the oil feeding amount is determined by the size of the oil restrictor and the differential pressure, therefore, the size of the oil restrictor has been determined by giving top priority to the assurance of the oil feeing amount necessary for bearings even in the minimum differential pressure condition as minimum requirement. Accordingly, it is difficult to suitably adjust the oil feeding amount in operation conditions other than the minimum differential pressure condition because the oil feeding amount is increased as the differential pressure is increased, and when the oil feeding amount is increased, the heating amount of the suction gas is increased with the increase of oil discharged to the suction side after lubricating bearings, which leads to reduction in performance. As the oil discharged to the suction side is sucked into a compression working chamber, power loss caused by agitation of oil inside the compression working chamber is increased with the increase of the oil feeding amount, and the performance is reduced also due to this aspect.

When the oil feeding amount is reduced by increasing the restriction amount of the oil restrictor, it is difficult to secure the oil feeding amount necessary for bearings in the minimum differential pressure condition, which causes problems that reliability of bearings is reduced and leakage from a seal line formed in the compression working chamber is increased due to a shortage of oil inside the compression working chamber to cause the reduction in performance.

The invention described in Patent Literature 1 includes a lubrication path through which oil for lubricating high-pressure side bearings circulates, a sealed portion in which a clearance for circulating oil after being fed to the compression chamber to the lubrication path, a communicating path allowing an oil reservoir to communicate with the lubrication path and a valve element closing the communication path when a differential pressure is higher than a predetermined pressure and opening the communication path when the differential pressure is lower than the predetermined pressure. Accordingly, the oil feeding amount with respect to high-pressure side bearings is optimized.

However, a high oil pressure acts on a counter spring-side of the valve element and a low oil pressure acts on a spring-side of the valve element in the invention described in Patent Literature 1, therefore, the oil feeding amount can be increased only in a state where a high and low pressure difference does not exist such as a case just after activation or in a case where the differential pressure is lower than a predetermined pressure, however, in the case where the high and low differential pressure is secured to be equal to or higher than the predetermined pressure, the valve element moves to the spring side and closed, therefore, it is difficult to change the oil feeding amount during operation. Furthermore, when the compressor is used with high start-and-stop frequency, the valve element repeats opening/closing in accordance with start/stop of the compressor, therefore, abrasion powder may be generated and a crack may occur in a sliding portion, which may reduce the reliability of bearings.

An object of the present invention is to provide a screw compressor capable of securing a sufficient oil feeding amount necessary for bearings even when the pressure difference is small, and suppressing the oil feeding amount to increase more than necessary even when the pressure difference is increased under a standard operation condition which requires performance, by allowing the oil feeding amount to be changed during operation.

Solution to Problem

A screw compressor according to the present invention has a screw rotor, an electric motor for driving the screw rotor, bearings supporting the screw rotor and casings housing these members, which includes an oil feeding passage formed in the casing for feeding oil on a high pressure side to the bearings by a differential pressure between the high pressure side and a low pressure side and an oil feeding amount adjusting unit provided in a middle of the oil feeding passage, in which the oil feeding amount adjusting unit includes a cylinder, a valve element provided so as to reciprocate freely inside the cylinder, and plural flow paths provided in the valve element having different flow path areas, and the plural flow paths are switched to adjust an oil feeding amount to be fed to the bearings by moving the valve element in accordance with the differential pressure between the high pressure side and the low pressure side.

A screw compressor according to another aspect of the present invention has a screw rotor, an electric motor for driving the screw rotor, bearings supporting the screw rotor and casings housing these members, which includes an oil feeding passage formed in the casing for feeding oil on a high pressure side to the bearings by a differential pressure between the high pressure side and a low pressure side and an oil feeding amount adjusting unit provided in a middle of the oil feeding passage, in which the oil feeding amount adjusting unit includes a cylinder, a valve element provided so as to reciprocate freely inside the cylinder, a first flow path provided in the valve element and having a large flow path area, and a second flow path having a smaller flow path area than the flow path area of the first flow path, a suction-side communicating path introducing and giving a suction side pressure of the compressor to one side surface of the valve element, a solenoid valve opening/closing the suction-side communicating path, and a leak-out means provided in the valve element for allowing oil in the oil feeding passage to leak out on one side surface of the valve element, and the first flow path and the second flow path are switched by moving the valve element by opening/closing the solenoid valve in accordance with the differential pressure between the high pressure side and the low pressure side.

Advantageous Effects of Invention

According to the present invention, there is an advantage of obtaining a screw compressor in which the oil feeding amount can be changed during operation, and a sufficient oil feeding amount necessary for bearings can be secured even when a differential pressure is low as well as more-than-necessary increase of the oil feeding amount can be suppressed in the case where the differential pressure is increased under a standard operation condition which requires performance.

BRIEF DESCRIPTION OF DRAWINGS

FIG. 1 is a vertical cross-sectional view showing the entire structure of a screw compressor according to Embodiment 1 of the present invention.

FIG. 2 is a horizontal cross-sectional view showing a relevant part of the screw compressor shown in FIG. 1.

FIG. 3 a cross-sectional view for explaining a structure of an oil feeding adjusting unit shown in FIG. 2 in an enlarged manner, which is the view showing a state where oil is fed to bearings through a first flow path of a valve element.

FIG. 4 is a view similar to FIG. 3, showing a state where oil is fed to bearings through a second flow path of the valve element.

FIG. 5 is a diagram for explaining a relation between the differential pressure and the oil feeding amount according to Embodiment 1.

FIG. 6 is an enlarged view of the valve element according to Embodiment 1, in which (a) is a front view and (b) is a left side view.

FIG. 7 is a view for explaining a screw compressor according to Embodiment 2 of the present invention, which corresponds to FIG. 3.

FIG. 8 is a view for explaining the screw compressor according to Embodiment 2 of the present invention, which corresponds to FIG. 4.

FIG. 9 is an enlarged view for explaining a structure of a valve element in a screw compressor according to Embodiment 3 of the present invention, in which (a) is a front view and (b) is a right side view.

FIG. 10 is a view for explaining an oil feeding amount adjusting unit according to Embodiment 3, which corresponds to FIG. 3.

FIG. 11 is a view for explaining the oil feeding amount adjusting unit according to Embodiment 3, which corresponds to FIG. 4.

FIG. 12 is a view for explaining Embodiment 4 of the present invention, which corresponds to FIG. 3.

FIG. 13 is a view for explaining Embodiment 4 of the present invention, which corresponds to FIG. 4.

FIG. 14 is a diagram for explaining a relation between the differential pressure and the oil feeding amount in the case where two oil feeding mount adjusting units are connected in series.

FIG. 15 shows front views of valve elements for explaining an upstream-side valve element (a) and a downstream-side valve element (b) at the time of arranging two oil feeding amount adjusting units in series.

FIG. 16 is an enlarged view of a relevant part for explaining a first example of a groove shape for the first flow path and the second flow path of the valve element.

FIG. 17 is an enlarged view of a relevant part for explaining a second example of the groove shape for the first flow path and the second flow path of the valve element.

FIG. 18 is an enlarged view of a relevant part for explaining a third example of the groove shape for the first flow path and the second flow path of the valve element.

DESCRIPTION OF EMBODIMENTS

Hereinafter, specific embodiments of a screw compressor of the present invention will be explained with reference to the drawings. In respective drawings, portions to which same symbols are given show the same or corresponding portions.

Embodiment 1

Hereinafter, a screw compressor according to Embodiment 1 of the present invention will be explained with reference to FIG. 1 to FIG. 6.

FIG. 1 is a vertical cross-sectional view showing the entire structure of the screw compressor according to Embodiment 1 of the present invention and FIG. 2 is a horizontal cross-sectional view showing a relevant part of the screw compressor shown in FIG. 1. The entire structure of the screw compressor according to Embodiment 1 will be explained with reference to FIG. 1 and FIG. 2.

A screw compressor 100 according to Embodiment 1 shown in FIG. 1 is a hermetic twin-screw compressor. However, the present invention is not limited to the hermetic twin-screw compressor, and may be a semi-hermetic twin-screw compressor, or and may be a single-screw compressor having one screw rotor as described in Patent Literature 1.

In FIG. 1, the screw compressor 100 configures a casing by a motor casing 1, a main casing 2 and a discharge casing 3 which are connected with one another in a hermetic manner. The casing is formed of a casting.

The motor casing 1 houses a driving motor 4 (electric motor) for driving a compression mechanism unit. The driving motor 4 includes a stator 20 fixed inside the motor casing 1 and a motor rotor 21 provided inside the stator 20 so as to rotate freely, and the power is supplied to the driving motor 4 through a power supply terminal 52 and a cable 53 provided inside a terminal box 51 in an outer side of the motor casing 1.

A suction port 18 is provided at an end portion of the motor casing 1 and a strainer 19 for collecting foreign matters is attached to the suction port 18. The strainer 19 is fixed by being sandwiched between a fixing flange 65 and the motor casing 1. A suction pipe 64 for sucking a refrigerant circulating in a refrigerating cycle (not shown) is connected to the fixing flange 65.

In the main casing 2, a cylindrical bore 5 and a suction port 6 for introducing a refrigerant gas into the cylindrical bore 5 are formed. In the cylindrical bore 5, a male rotor 11A rotatably supported by roller bearings 7A, 8A and 9A and a ball bearing 10A and a female rotor 11B rotatably supported by roller bearings 8B and 9B and a ball bearing 10B are housed by being engaged with each other as shown in FIG. 2. The male rotor 11A and the female rotor 11B configure a pair of male and female screw rotors which are engaged with each other. The screw rotor, the cylindrical bore 5 formed in the main casing 2 and the like configure the compression mechanism unit.

As shown in FIG. 1 and FIG. 2, a shaft of the male rotor 11A is directly connected to the motor rotor 21 of the driving motor 4 on a low pressure side. On a side surface of the main casing 2, an oil separator 12 is integrally formed. The refrigerant gas and oil compressed in the compression mechanism unit enter the oil separator 12 and separated, and the separated oil is stored in an oil reservoir 14 formed in a lower part of the oil separator 12. Therefore, a pressure in the oil reservoir 14 is equivalent to a discharge-side pressure.

In the discharge casing 3, the roller bearings 9A, 9B and the ball bearings 10A, 10B are housed, and a discharge passage (not shown) for the refrigerant gas communicating with the oil separator 12 is formed. The discharge casing 3 is fixed to the main casing 2 by bolts. Additionally, bearing chambers 16A and 16B housing the roller bearings 9A, 9B and the ball bearings 10A, 10B are formed in the discharge casing 3, and further, a shielding plate 17 for blocking the bearing chambers 16A and 16B is attached to an outer-side end portion of the discharge casing 3.

Shafts of the male rotor 11A and the female rotor 11B on the low pressure side are supported by the roller bearings 7A, 8A and 8B, and the shafts of the male rotor 11A and the female rotor 11B on the high pressure side are supported by the roller bearings 9A, 9B and the ball bearings 10A and 10B. Accordingly, the roller bearings 7A, 8A and 8B configure low-pressure side bearings and the roller bearings 9A, 9B and the ball bearings 10A and 10B configure high-pressure side bearings.

In the respective casings 1 to 3 of the screw compressor 100, oil feeding passages 15A, 15B and 15C for feeding oil in the oil reservoir 14 of the oil separator 12 to the respective bearings by the differential pressure are formed as shown in FIG. 2. In the present embodiment, later-described oil feeding amount adjusting units 30 are respectively provided in a middle of the oil feeding passage 15B with respect to the low-pressure side bearings (roller bearings 7A, 8A and 8B) and in a middle of the oil feeding passage 15C with respect to the high-pressure side bearings (roller bearings 9A, 9B and the ball bearings 10A, 10B).

Furthermore, the screw compressor 100 is provided with a capacity control mechanism unit configured by a slide valve 26, a rod 27, a hydraulic piston 28, a coil spring 29 and the like. The slide valve 26 is housed so as to reciprocate inside a concave portion 2*a* formed inside the main casing 2 in the axial direction. The capacity of the compressor can be controlled by moving the position of the slide valve 26 to bypass part of a refrigerant gas sucked to an engaged portion between the male rotor 11A and the female rotor 11B to the suction side.

The rod 27, the hydraulic piston 28 and the coil spring 29 are housed in the discharge casing 3. The hydraulic piston 28 and the coil spring 29 are provided inside a cylinder 3*a* formed inside the discharge casing 3 in the axial direction (right and left direction of FIG. 1). The coil spring 29 is arranged inside the cylinder 3*a* at a position closer to the slide valve 26 than the hydraulic piston 28, giving a force of constantly pressing the hydraulic piston 28 to a reverse side of the slide valve 26 (a right direction in the drawing).

The hydraulic piston 28 is housed inside the cylinder 3*a* so as to slide in the axial direction. The hydraulic piston 28 is moved by feeding/discharging oil into/from a cylinder chamber Q of the cylinder 3*a* to adjust an oil amount inside the cylinder chamber Q. The operation of the hydraulic piston 28 is transmitted to the slide valve 26 through the rod 27, thereby moving the position of the slide valve 26 in the axial direction and operating the compressor with a predetermined capacity.

In FIG. 1, a hydraulic system for adjusting the oil amount by feeding/discharging oil into/from the cylinder chamber Q, an solenoid valve switching the hydraulic system are not shown.

Next, flows of the refrigerant gas and the oil in the screw compressor shown in FIG. 1 and FIG. 2 will be explained. After foreign matters are collected by the strainer 19, the refrigerant gas with a low temperature and a low pressure sucked from the suction port 18 provided in the motor casing 1 passes through a gas passage 4*a* provided between the driving motor 4 and the motor casing 1 and an air gap 4*b* between the stator 20 of the driving motor 4 and the motor rotor 21 to thereby cool the driving motor 4.

The refrigerant gas used for cooling the driving motor is subsequently sucked into a compression chamber (compression working chamber) formed by an engaged tooth surface between the male rotor 11A and the female rotor 11B and the main casing 2 from the suction port 6 formed in the main casing 2. After that, the refrigerant gas is sealed in the compression chamber formed by the engaged tooth surface between the male rotor 11A and the female rotor 11B and the main casing 2 with rotation of the male rotor 11A directly connected to the driving moto 4 and gradually compressed with compression in the compression chamber to be discharged into the oil separator 12 integrally formed with the main casing 2 as a refrigerant gas with a high temperature and a high pressure.

In compression reaction forces acting on the male rotor 11A and the female rotor 11B at the time of compression, a radial load is supported by the roller bearings 7A, 8A, 8B, 9A and 9B, and a thrust load is supported by the ball bearings 10A and 10B.

The feeding of oil for lubrication to the roller bearings 7A, 8A, 8B, 9A and 9B and the ball bearings 10A and 10B will be explained. First, the oil in the oil reservoir 14 of the oil separator 12 which is on the high-pressure side of the main casing 2 is introduced by a differential pressure with respect to the low-pressure side through the oil feeding passage 15A and separated into the oil feeding passages 15B and 15C. The oil separated into the oil feeding passage 15B passes through the oil feeding amount adjusting unit 30, lubricating and cooling the low-pressure side bearings (suction side bearings; the roller bearings 7A, 8A and 8B) to be discharged to the suction port 6 side.

The oil separated to the oil feeding passage 15C also passes through the oil feeding amount adjusting unit 30 provided in the oil feeding passage 15C, lubricating and cooling the high-pressure side bearings (discharge-side bearings; roller bearings 9A, 9B and the ball bearings 10A and 10B) to be discharged to the suction port 6 side or to the compression chamber just after the suction is completed and so on.

The oil discharged after lubricating respective bearings flows with the compression refrigerant gas while lubricating the compression working chamber, being discharged with the compression refrigerant gas and flowing into the oil separator 12. In this oil separator 12, the oil is stored again in the oil reservoir 14 provided in the lower part of the oil separator and the compression refrigerant gas is fed to the refrigerating cycle. 46 denotes a suction pressure measuring device (suction pressure sensor) provided in the suction pipe 64 for measuring a pressure of the suction refrigerant gas sucked by the screw compressor 100, 47 denotes a discharge pressure measuring device (discharge pressure sensor) provided in a discharge pipe 66 for measuring a pressure of the compression refrigerant gas discharged from the screw compressor 100, and 48 denotes a controller for controlling the oil feeding amount adjusting units 30 in accordance with a differential pressure between a suction pressure and a discharge pressure measured by the suction pressure measuring device 46 and the discharge pressure measuring device 47. In more detail, the controller 48 converts signals from the suction pressure measuring device 46 and the discharge pressure measuring device 47 into the suction pressure and the discharge pressure, calculating the differential pressure from a difference between the suction pressure and the discharge pressure, and comparing the differential pressure with a predetermined value set in the controller 48 to control the oil feeding amount adjusting unit 30 in accordance with the comparison result.

Next, a structure in the vicinity of the oil feeding amount adjusting unit 30 provided on the oil feeding passage 15B side shown in FIG. 2 will be explained in detail with reference to FIG. 3 and FIG. 4. As the oil feeding amount adjusting unit 30 provided on the oil feeding passage 15C has the same structure, the explanation is omitted.

FIG. 3 is a cross-sectional view for explaining the structure of the oil feeding adjusting unit 30 shown in FIG. 2 in an enlarged manner, which is the view showing a state where oil is fed to bearings through a first flow path 36 of a valve element, and FIG. 4 is a view similar to FIG. 3, showing a state where oil is fed to bearings through a second flow path 37 of the valve element.

In FIG. 3 and FIG. 4, the oil feeding amount adjusting unit 30 provided in the oil feeding passage 15B includes a cylinder 35 formed in the casing in the middle of the oil feeding passage 15B, a valve element 31 provided so as to slide and reciprocate freely inside the cylinder 35, plural flow paths (the first flow path 36 and the second flow path 37) having different flow path areas provided in the valve element 31 and a spring 34 arranged in the cylinder 35 on the right side of the valve element 31 and giving a force of constantly pressing the valve element 31 to a left direction in the drawing. The valve element 31 is moved in accordance with the differential pressure between the high-pressure side (discharge side) and the low-pressure side (suction side), thereby switching the plural flow paths and adjusting the oil feeding amount to be fed to the low-pressure side bearings (the roller bearings 7A, 8A and 8B).

That is, the first flow path 36 with a larger flow path area and the second flow path 37 with a smaller flow path area than the flow path area of the first flow path 36 are formed in the valve element 31. A suction-side communicating path 40A for introducing and giving the suction-side pressure of the compressor to one side surface (valve element left surface) 32 of the valve element 31 and a discharge-side communicating path 40B for introducing and giving the discharge-side pressure of the compressor to one side surface are provided. The discharge-side pressure or the suction-side pressure is given to the one side surface 32 of the valve element 31 to move the valve element 31 by opening/closing the respective communicating paths 40A and 40B, thereby switching between the first flow path 36 and the second flow path 37 formed in the valve element 31.

39A denotes a communicating hole for giving the suction-side (low-pressure side) pressure inside the compressor to a right surface 33 of the valve element 31, and 39B denotes a communicating hole for introducing the suction-side pressure from the suction-side communicating path 40A or the discharge-side pressure from the discharge-side communicating path 40B to the left surface 32 of the valve element 31. 42 denotes a clearance formed between the valve element 31 and the cylinder 35.

The suction-side communicating path 40A is provided with a solenoid valve 38A and the discharge-side communicating path 40B is provided with a solenoid valve 38B, and these solenoid valves 38A and 38B are controlled by the controller 48. That is, the suction pressure measuring device 46 for measuring the suction pressure and the discharge pressure measuring device 47 for measuring the discharge pressure are provided as shown in FIG. 1, and the controller 48 controls opening/closing of the solenoid valves 38A and 38B in accordance with the differential pressure between the suction pressure and the discharge pressure measured by the suction pressure measuring device 46 and the discharge pressure measuring device 47.

For example, in the case where the differential pressure between the measured suction pressure and the discharge pressure is lower than a predetermined value previously set by the controller 48, the controller 48 allows the solenoid valve 38A to be closed and allows the solenoid valve 38B to be opened as shown in FIG. 3, thereby introducing the discharge side high-pressure oil into the cylinder 35 through the discharge-side communicating path 40B and the communicating hole 39B, and giving a discharge-side pressure Pd of the compressor to the left surface 32 of the valve element 31. In the present embodiment, a suction-side pressure Ps is given to the right surface 33 of the valve element 31 through the communicating hole 39A.

Here, a spring force of the spring 34 is set to be smaller than a force generated in the valve element 31 by the differential pressure when the differential pressure between the discharge pressure (high-pressure side pressure; discharge-side oil pressure) and the suction pressure (low-pressure side pressure) is the lowest under operation conditions of the compressor. Therefore, the force due to the differential pressure generated in the valve element left surface 32 and the valve element right surface 33 overcomes the spring force and the valve element 31 moves in the right side as shown in FIG. 3, as a result, the first flow path 36 of the valve element 31 communicates with the oil feeding passage 15B. As the flow path area of the first flow path 36 is large, sufficient oil can be fed to the low-pressure side bearings 7A, 8A and 8B even when the differential pressure is low.

In the case where the differential pressure between the measured suction pressure and the discharge pressure is equal to or higher than the predetermined value previously set in the controller 48, the controller 48 allows solenoid valve 38A to be opened and allows the solenoid valve 38B to be closed as shown in FIG. 4. Accordingly, the high-pressure oil from the discharge-side communicating path 40B is blocked by the solenoid valve 38B, and the high-pressure oil pressure inside the communicating hole 39B passes through the solenoid valve 38A and flows out to the suction side. Therefore, the suction-side pressure Ps of the compressor is given to the left surface 32 of the valve element 31 through the suction-side communicating path 40A and the communicating hole 39B. Though the suction-side pressure Ps is given to the right surface 33, the valve element 31 is pressed in the left side by the spring 34, therefore, the valve element 31 moves in the left side as shown in FIG. 4, and the second flow path 37 of the valve element 31 communicates with the oil feeding passage 15B. As the flow path area of the second flow path 37 is small, it is possible to suppress excessive feeding of oil to the low-pressure side bearings 7A, 8A and 8B even when the differential pressure is high.

As described above, the first flow path groove 36 and the second flow path 37 having different flow path areas can be arbitrarily switched by moving the valve element 31 by the differential pressure and the spring force acting on the valve element 31, and an oil amount suitable for operation conditions can be fed to the low-pressure side bearings 7A, 8A and 8B.

It is also preferable to switch between the suction-side communicating path 40A and the discharge-side communicating path 40B by using a three-way valve instead of using the solenoid valves 38A and 38B.

Next, a specific example in which the oil feeding amount to the bearings is changed by switching between the first flow path and the second flow path by moving the valve element in accordance with the differential pressure between the high pressure side and the low pressure side will be explained with reference to FIG. 5. FIG. 5 is a diagram for explaining a relation between the differential pressure and the oil feeding amount according to Embodiment 1. In the drawing, a curve A indicates variation of the oil feeding amount with respect to the differential pressure in the case where the first flow path 36 of the valve element 31 opens to the oil feeding passage 15B and a curve B indicates variation of the oil feeding amount with respect to the differential pressure in the case where the second flow path 37 of the valve element 31 opens to the oil feeding amount 15B. As the flow path area of the first flow path 36 is larger than the flow path area of the second flow path 37, the oil feeding amount with respect to the differential pressure is also larger.

In FIG. 5, an operation state performed when the differential pressure is lower than a predetermined value (first predetermined value) c1 is defined as a low-differential pressure operation, and an operation state performed when the differential pressure is equal to or higher than the predetermined value c1 is defined as a standard operation. Furthermore, a predetermined value (second predetermined value) c2 of the differential pressure which is higher than the predetermined value c1 is also set in the present embodiment, and an operation state performed when the differential pressure is equal to or higher than the second predetermined value c2 which is particularly high is defined as a high load operation. These predetermined values c1 and c2 are previously set in the controller 48.

At the time of the low-differential pressure operation where the differential pressure is lower than the predetermined value c1, the oil in the oil feeding passage 15B is allowed to flow through the first flow path 36 as shown in FIG. 3, thereby securing a sufficient oil feeding amount even when the differential pressure is low and promoting lubrication and cooling of bearings, as a result, reliability of bearings can be improved.

In the case where the differential pressure is equal to or more than the predetermined value c1 to be under the standard operation condition which requires performance, the flow path is switched from the first flow path 36 to the second flow path 37 by moving the valve element 31 (see FIG. 4), thereby allowing the oil in the oil feeding passage 15B to flow through the second flow path 37. Accordingly, the increase of the oil feeding amount can be suppressed as shown by the curve B of FIG. 5 and the heating of the suction refrigerant gas due to the high-temperature oil after cooling the bearings can be reduced. Furthermore, agitation loss of oil sucked into the compression chamber can be reduced, therefore, performance can be improved.

Furthermore, the bearing load is increased and the temperature of the compression gas is also increased at the time of the high load operation in which the differential pressure is equal to or more than the predetermined value c2 in the present embodiment, therefore, the oil feeding amount is controlled to be increased as shown by the curve A of FIG. 5 by allowing the oil in the oil feeding passage 15B to flow again through the first flow path 36 for increasing the feeding amount of oil to bearings to increase the reliability and also for promoting cooling.

Next, a structure of the valve element 31 will be explained with reference to FIG. 6. FIG. 6 is an enlarged view of the valve element 31 according to Embodiment 1, in which (a) is a front view and (b) is a left side view. As shown in the drawing, a groove 49 extending from an outer peripheral side toward the central side of the valve element 31 is formed on the valve element left surface 32 of the valve element 31. The groove 49 is formed so as to communicate with the clearance 42 (see FIG. 3 and FIG. 4) between the valve element 31 and the cylinder 35, and the clearance 42 communicates with the inside of the cylinder chamber of the valve element left surface 32 or the communicating hole 39B through the groove 49.

As the solenoid valves 38A and 38B shown in FIG. 3 and FIG. 4, exciting open type solenoid valves (solenoid valves operated to be opened when current is applied to the solenoid valves and operated to be closed when current application is stopped) are used in the present embodiment.

According to the above, for example, when the solenoid valves are not capable of being opened due to a failure of the solenoid valves 38A and 38B, the high-pressure oil in the oil feeding passage 15B flows into the cylinder chamber on the valve element left surface 32 side or the communicating hole 39B from the clearance 42 between the valve element 31 and the cylinder 35 through the groove 49. As the pressure acting on the valve element left surface 32 is gradually increased, the valve element 31 moves in the right side (spring's side)

and the first flow path 36 with the large flow path area opens to the oil feeding path 15B. Accordingly, when the solenoid valve 38A and 38B fail, a sufficient amount of oil can be constantly fed to bearings regardless of operation conditions, therefore, there is an advantage that the reliability can be secured even when a failure occurs during operation.

In the case where only the solenoid valve 38B fails and the solenoid valve 38B is not capable of being opened, the high-pressure oil in the oil feeding passage 15B flows into the cylinder chamber on the valve element left surface 32 side or the communicating hole 39B from the clearance 42 between the valve element 31 and the cylinder 35 through the groove 49 by closing the solenoid valve 38A, and the valve element 31 moves in the right side and the first flow path 36 with the large flow path area opens to the oil feeding passage 15B in the same manner as described above. Accordingly, the sufficient amount of oil can be constantly fed to bearings even when only the solenoid valve 38B fails.

In the case where only the coil of the solenoid valve 38A fails and the solenoid valve 38B is not capable of being opened, the high-pressure oil in the oil feeding passage 15B flows into the communicating hole 39B and the cylinder chamber of the valve element left surface 32 via the solenoid valve 38B by constantly opening the solenoid valve 38B, therefore, the valve element 31 moves in the right side and the first flow path 36 with the large flow path area opens to the oil feeding passage 15B. Accordingly, the sufficient amount of oil can be fed to bearings regardless of operation conditions also in this case.

The above is the example in which the exciting open type solenoid valves are used as the solenoid vales 38A and 38B. When exciting close type solenoid valves are used, the solenoid valves are constantly opened in the case where the solenoid valves fail.

In the case where both of the exciting close type solenoid valves 38A and 38B fail, or only the solenoid valve 38A fails, the pressure acting on the valve element left surface 32 is increased to be higher than the low-pressure side pressure by constantly opening the solenoid valve 38B, and the spring force of the spring 34 is adjusted so that the valve element 31 is constantly pressed to the right side, thereby allowing the first flow path 36 with the large flow path area to open to the oil feeding passage 15B. Therefore, the sufficient amount of oil can be constantly fed to bearings regardless of operation conditions and the reliability can be secured even when the solenoid valves fail during operation.

According to the embodiment of the present invention explained as the above, the oil feeding amount can be changed during operation, and a sufficient feeding amount of oil necessary for bearings can be secured even when the differential pressure is low to promote lubrication and cooling of bearings. Also in the case where the differential pressure is increased under the standard operation condition which requires performance, it is possible to suppress the oil feeding amount to increase more than necessary and to suppress a heating amount of the suction gas to increase due to high-temperature oil after cooling bearings. Furthermore, the feeding amount of oil to bearings is increased at the time of high load operation, therefore, it is possible to obtain advantages that the reliability is increased and cooling can be promoted.

Embodiment 2

Next, a screw compressor according to Embodiment 2 of the present invention will be explained with reference to FIG. 7 and FIG. 8. FIG. 7 is a view for explaining Embodiment 2, which corresponds to FIG. 3, and FIG. 8 is a view for explaining Embodiment 2, which corresponds to FIG. 4. In Embodiment 2, explanation about the same portions as those of Embodiment 1 is omitted, and portions different from those of Embodiment 1 will be mainly explained.

In Embodiment 2, the spring 35 is set inside the cylinder 35 on the left side of the valve element 31, giving a force of constantly pressing the valve element 31 in the right side of the drawing. On the right surface 33 of the valve element 31, a communicating path 40C is formed so that high-pressure oil separated from the oil feeding passage 15B is introduced.

On the left surface 32 side of the valve element 31, the suction-side communicating path 40A, the discharge-side communicating path 40B and the communicating hole 39B are provided for introducing the suction pressure or the discharge pressure (high-pressure oil) in the same manner as the above Embodiment 1. The solenoid valves 38A and 38B are provided in paths of the respective communicating paths 40A and 40B, and the solenoid valves 38A and 38B are connected to the controller 48. The controller 48 is configured to control the solenoid valves 38A and 38B to be opened and closed in accordance with a differential pressure between the detected suction pressure and the discharge pressure.

Embodiment 2 is configured to introduce high-pressure oil to the right surface 33 of the valve element 31 from the oil feeding passage 15B through the communicating path 40C, therefore, discharge of oil to the compressor suction side can be further reduced and heating of the suction refrigerant gas due to the high-temperature oil can be reduced, thereby reducing heating loss.

Next, the control of the oil feeding amount adjusting unit 30 will be explained.

In the case where the oil amount to be fed to bearings is increased, the valve element 31 is moved in the right side to thereby allow the first flow path 36 with the large flow path area to open to the oil feeding passage 15B as shown in FIG. 7. In order to realize this, the solenoid valve 38A is closed and the solenoid valve 38B is opened. Accordingly, the high-pressure oil on the discharge side passes through the discharge-side communicating path 40B and the communicating hole 39B and flows into the cylinder 35 on the valve element left surface 32 side, therefore, the discharge side pressure Pd of the compressor acts on the valve element left surface 32. As the discharge-side high pressure oil (discharge side pressure Pd) constantly acts also on the valve element right surface 33 through the communicating path 40C, there is no differential pressure generated between the left surface 32 and the right surface 33 of the valve element 31, and the valve element 31 moves in the right side by the spring force of the spring 34.

In the case where the oil amount to be fed to bearings is reduced, the valve element 31 is moved to the left side to thereby allow the second flow path 37 with the small flow path area to open to the oil feeding passage 15B as shown in FIG. 8. In order to realize this, the solenoid valve 38A is opened and the solenoid valve 38B is closed, as a result, the high-pressure oil on the discharge side is blocked by the solenoid valve 38B and the high-pressure oil inside the communicating hole 39B passes through the solenoid valve 38A and flows out to the suction side, and the suction side pressure Ps acts on the valve element left surface 32. The discharge side pressure Pd constantly acts on the valve element right surface 33 by the communicating hole 40C. At the time of minimum differential pressure between the discharge pressure (high pressure side pressure Pd) and the suction pressure (low pressure side pressure Ps) under operation conditions of compressor, the spring force of the spring 34 is set to be smaller than a force generated in the valve element 31 due to the above differential pressure. Therefore, the force due to the differential pressure generated between the left surface 32 and the right surface 33 of the valve element 31 overcomes the spring force, as a result, the valve element 31 moves in the left side.

As other structures are the same as those of Embodiment 1, the explanation is omitted.

Also in Embodiment 2, the first flow path groove 36 and the second flow path 37 having different flow path areas can be arbitrarily switched by moving the valve element 31 by the differential pressure and the spring force acting on the valve element 31 in the same manner as Embodiment 1, therefore, the oil amount suitable for operation conditions can be fed to the low-pressure side bearings 7A, 8A and 8B.

Also in Embodiment 2, exciting open type solenoid valves are used as the solenoid valves 38A and 38B.

For example, when the solenoid valves are not capable of being opened due to a failure of the solenoid valves 38A and 38B, the high-pressure oil in the oil feeding passage 15B flows into the cylinder chamber on the valve element left surface 32 side or the communicating hole 39B from the clearance 42 between the valve element 31 and the cylinder 35 through the groove 49 (see FIG. 6). As the pressure acting on the valve element left surface 32 is gradually increased, there is no difference generated between the valve element left element 32 and the valve element right element 33, therefore, the valve element 31 moves in the right side (counter spring's side) and the first flow path 36 with the large flow path area opens to the oil feeding path 15B. Accordingly, when the solenoid valve 38A and 38B fail, a sufficient amount of oil can be constantly fed to bearings regardless of operation conditions, therefore, there is an advantage that the reliability can be secured even when a failure occurs during operation.

In the case where only the coil of the solenoid valve 38B fails and the solenoid valve 38B is not capable of being opened, the high-pressure oil in the oil feeding passage 15B flows into the cylinder chamber on the valve element left surface 32 side or the communicating hole 39B from the clearance 42 between the valve element 31 and the cylinder 35 through the groove 49 by closing the solenoid valve 38A, and the valve element 31 moves in the right side and the first flow path 36 with the large flow path area opens to the oil feeding passage 15B in the same manner as described above. Accordingly, the sufficient amount of oil can be constantly fed to bearings even when only the solenoid valve 38B fails.

In the case where only the coil of the solenoid valve 38A fails and the solenoid valve 38B is not capable of being opened, the high-pressure oil in the oil feeding passage 15B flows into the communicating hole 39B and the cylinder chamber of the valve element left surface 32 via the solenoid valve 38B by constantly opening the solenoid valve 38B, therefore, the valve element 31 moves in the right side and the first flow path 36 with the large flow path area opens to the oil feeding passage 15B. Accordingly, the sufficient amount of oil can be fed to bearings regardless of operation conditions also in this case.

The above is the example in which the exciting open type solenoid valves are used as the solenoid vales 38A and 38B. When exciting close type solenoid valves are used, the solenoid valves are constantly opened in the case where the solenoid valves fail.

In the case where both of the exciting close type solenoid valves 38A and 38B fail, both of the solenoid valves 38A and 38B open, and the pressure acting on the valve element left surface 32 becomes higher than that of the low pressure side pressure. As the spring force of the spring 34 is also added, the valve element 31 is pressed to the right side, the first flow path 36 with the larger flow path area opens to the oil passage 15B and the sufficient amount of oil can be supplied to the bearings, as a result, the reliability can be secured even when a failure occurs during operation.

In the case where only the solenoid valve 38A fails, in the same manner as described above the pressure acting on the valve element left surface 32 is increased to be higher than the low-pressure side pressure by opening the solenoid valve 38B, and the valve element 31 is pressed to the right side as the spring force of the spring 34 is also added, thereby allowing the first flow path 36 with the large flow path area to open to the oil feeding passage 15B. Therefore, the sufficient amount of oil can be fed to bearings and the reliability can be secured even when a failure occurs during operation. Moreover, when the solenoid valve 38B is closed, the pressure acting on the valve element left surface 32 becomes the low pressure side (suction side) pressure Ps, therefore, the valve element 31 can be moved in the left side and the second flow path 37 with the small flow path area can be opened to the oil feeding passage 15B.

In the case where only the solenoid valve 38B fails, the valve element 31 can be moved in the right side and the first flow path 36 having the large flow path area can be opened to the oil passage 15B by closing the solenoid valve 38A. When the solenoid valve 38A is opened, the pressure acting on the valve element left surface 32 becomes higher than the low pressure side pressure in the same manner as described above, and the valve element 31 can be moved in the right side as the spring force of the spring 34 is also added, thereby allowing the first flow path 36 with the large flow path area to open to the oil feeding passage 15B.

Embodiment 3

A screw compressor according to Embodiment 3 of the present invention will be explained with reference to FIG. 9 to FIG. 11. FIG. 9 is an enlarged view for explaining a structure of a valve element according to Embodiment 3, in which (a) is a front view and (b) is a right side view, FIG. 10 is a view for explaining an oil feeding amount adjusting unit according to Embodiment 3, which corresponds to FIG. 3 or FIG. 7, and FIG. 11 is a view for explaining the oil feeding amount adjusting unit according to Embodiment 3, which corresponds to FIG. 4 or FIG. 8. In Embodiment 3, explanation about the same portions as those of Embodiments 1 and 2 is omitted, and portions different from those of Embodiments 1 and 2 will be mainly explained.

FIG. 9 shows the structure of the valve element 31 according to Embodiment 3. Embodiment 3 is the same in a point that the first flow path 36 and the second flow path 37 are provided in the valve element 31. In the present embodiment, drilled holes (oil passages) 43A and 43B extending from an outer peripheral side toward the center of the valve element 31 are formed in the first flow path 36 and the second flow path 37, and a drilled hole (oil passage) 43C in an axial direction opening to the valve element right surface 33 is formed in the center of the valve element 31 so that the drilled holes 43A, 43B communicate with the drilled hole 43C. Other structures are the same as those of the respective embodiments.

The structure of the oil feeding amount adjusting unit 30 according to Embodiment 3 will be explained with reference to FIG. 10 and FIG. 11.

The valve element 31 having the drilled holes 43A, 43B and 43C is provided so as to slide and reciprocate inside the cylinder 35 formed in the casing (the motor casing 1 or the main casing 2). In the present embodiment, the spring 34 is arranged inside the cylinder 35 on the valve element left surface 32 side, constantly giving the force of pressing the valve element 31 to the right direction in the drawing in the same manner as the above Embodiment 2. The cylinder 35 on the right surface 33 side of the valve element 31 is closed, and the above communicating hole 39A (Embodiment 1) and the communicating hole 40C (Embodiment 2) are not formed.

In the same manner as the above Embodiments 1 and 2, the communicating hole 39B, the suction-side communicating path 40A and the discharge-side communicating path 40B are provided for introducing the low-pressure side (suction side) pressure Ps and the high-pressure side (discharge side) pressure Pd into the cylinder 35 on the valve element left surface 32 side. A space 44 is provided on the valve element right surface side inside the cylinder 35 to secure a surface to the valve element right surface 33 on which an oil pressure acts.

In the same manner as the above Embodiments 1 and 2, the solenoid valves 38A and 38B are provided in paths of the respective communicating paths 40A and 40B, and the solenoid valves 38A and 38B are connected to the controller 48, which controls the solenoid valves 38A and 38B to be opened and closed in accordance with a differential pressure between the suction pressure and the discharge pressure detected by the pressure measuring devices 46 and 47 (see FIG. 1).

Part of the high pressure oil flowing in the oil feeding passage 15B is introduced to the space 44 of the valve element right surface 33 through the drilled holes (oil passages) 43A, 43B and 43C, and the high pressure oil is stored in the space 44, therefore, the discharge side (high pressure side) pressure Pd acts on the valve element right surface 33.

It is not necessary to provide the communicating path 40C for introducing the high pressure oil to the valve element right surface 33 in Embodiment 3, which is different from Embodiment 2, therefore, the oil feeding path can be simplified.

Next, the control in Embodiment 3 will be explained with reference to FIG. 10 and FIG. 11.

In the case where the oil amount to be fed to bearings is increased, the valve element 31 is moved in the right side to allow the first flow path 36 with a large flow path area to open to the oil feeding passage 15B as shown in FIG. 10. In order to realize this, the solenoid valve 38A is closed and the solenoid valve 38B is opened. Accordingly, the high-pressure oil on the discharge side passes through the discharge-side communicating path 40B and the communicating hole 39B and flows into the cylinder 35 on the valve element left surface 32 side, therefore, the discharge side pressure Pd of the compressor acts on the valve element left surface 32. Moreover, as the discharge-side high pressure oil flows into the space 44 on the valve element right surface 32 side inside the cylinder 35 through the drilled holes 43A, 43B and 43C and is stored there, the pressure is gradually increased, as a result, the discharge side pressure Pd acts also on the valve element right surface 33. Therefore, there is no differential pressure generated between the left surface 32 and the right surface 33 of the valve element 31, and the valve element 31 moves in the right side by the spring force of the spring 34.

In the case where the oil amount to be fed to bearings is reduced, the valve element 31 is moved in the left side to allow the second flow path 37 with a small flow path area to open to the oil feeding passage 15B as shown in FIG. 11. Accordingly, the discharge-side high pressure oil is blocked by the solenoid valve 38B by opening the solenoid valve 38A and closing the solenoid valve 38B, and the high pressure oil in the communicating hole 39B passes through the solenoid valve 38A and flows out to the suction side, as a result, the low pressure side (suction side) pressure Ps acts on the valve element left surface 32. As the discharge-side high pressure oil flows into the space 44 on the valve element right surface 33 side in the cylinder 35 through the drilled holes 43A, 43B and 43C and is stored there, the pressure is gradually increased, as a result, the high-pressure side (discharge side) pressure Pd acts on the valve element right surface 33.

Note that the spring force of the spring 34 is set to be smaller than a force generated in the valve element 31 by the differential pressure when the differential pressure between the discharge pressure (high-pressure side pressure Pd) and the suction pressure (low-pressure side pressure Ps) is the lowest under operation conditions of the compressor. Therefore, the force due to the differential pressure generated in the left surface 32 and the right surface 33 of the valve element 31 overcomes the spring force and the valve element 31 moves in the left side.

As other structures are the same as those of the above Embodiments 1 or 2, the explanation is omitted.

Also in Embodiment 3, in the same manner as the above Embodiments 1 and 2, the first flow path 36 and the second flow path 37 having different flow path areas can be arbitrarily switched by moving the valve element 31 by the differential pressure and the spring force acting on the valve element 31, and an oil amount suitable for operation conditions can be fed to the low-pressure side bearings 7A, 8A and 8B.

Concerning operations at the time of a failure of the solenoid valves 38A and 38B, the same operations as the above Embodiment 2 are performed, thereby securing the reliability of the compressor.

Embodiment 4

A screw compressor according to Embodiment 4 of the present invention will be explained with reference to FIG. 12 and FIG. 13. FIG. 12 is a view for explaining an oil feeding amount adjusting unit according to Embodiment 4, which corresponds to FIG. 3, and FIG. 13 is a view for explaining the oil feeding amount adjusting unit according to Embodiment 4, which corresponds to FIG. 4. In Embodiment 4, explanation about the same portions as those of Embodiments 1 to 3 is omitted, and portions different from those of Embodiments 1 to 3 will be mainly explained.

Embodiment 4 is the same in a point that the valve element 31 is provided with the first flow path 36 and the second flow path 37, however, Embodiment 4 differs from the above Embodiments 1 to 3 in a point that the first flow path 36 is formed on the right side of the valve element 31 and the second flow path 37 is formed on the left side.

Embodiment 4 is the same as the above Embodiment 1 in the point that the valve element 31 is provided so as to slide and reciprocate inside the cylinder 35 formed in the casing (the motor casing 1 or the main casing 2), the point that the spring 34 is arranged inside the cylinder 35 on the valve element right surface 33 side to constantly give the force of pressing the valve element 31 in the left direction of the drawing, the point that the communicating hole 39A for giving the compressor suction-side pressure Ps to the right surface 33 of the valve element 31 is provided and in other points.

Embodiment 4 differs from the above Embodiment 1 in a point that only the suction-side communicating path 40A is connected to the inside of the cylinder 35 of the valve element left surface 32 through the communicating hole 39B. The solenoid valve 38A is provided in the path of the suction-side communicating path 40A, and the solenoid valve 38A is connected to the controller 48, which controls the solenoid valve 38A to be opened and closed in accordance with the differential pressure between the suction pressure and the discharge pressure measured by the respective pressure measuring devices 46 and 47 (see FIG. 1).

Other structures are the same as Embodiment 1.

Next, the control in Embodiment 4 will be explained with reference to FIG. 12 and FIG. 13.

In the case where the oil amount to be fed to bearings is increased, the valve element 31 is moved in the left side to allow the first flow path 36 with a large flow path area to open to the oil feeding passage 15B as shown in FIG. 12. In order to realize this, the solenoid valve 38A is opened. Accordingly, the suction side pressure Ps acts on the left surface 32 of the valve element 31 through the communicating hole 39B. As the low-pressure side (suction side) pressure Ps constantly acts on the right surface 33 of the valve element 31 from the communicating hole 39A, there is no differential pressure generated between the left surface 32 and the right surface 33 of the valve element 31, and the valve element 31 is moved to the left side by the spring force of the spring 34.

In the case where the oil amount to be fed to bearings is reduced, the valve element 31 is moved in the right side to allow the second flow path 37 with a small flow path area to open to the oil feeding passage 15B as shown in FIG. 13. Accordingly, the high-pressure oil in the oil feeding passage 15B flows into the communicating hole 39B from the clearance (leak-out means) 42 between the valve element 31 and the cylinder 35 through the groove 49 (see FIG. 6) and the high pressure oil is stored in the communicating hole 39B by closing the solenoid valve 38A. As a result, the pressure acting on the left surface 32 of the valve element 31 is gradually increased to be the high-pressure side (discharge side) pressure Pd, and the valve element 31 moves to the right side (spring's side).

Also in Embodiment 4, the first flow path groove 36 and the second flow path 37 having different flow path areas can be arbitrarily switched by moving the valve element 31 by the differential pressure and the spring force acting on the valve element 31 in the same manner as Embodiments 1 to 3, therefore, the oil amount suitable for operation conditions can be fed to the low-pressure side bearings 7A, 8A and 8B.

Furthermore, the discharge-side communicating path 40B and the solenoid valve 38B provided in the discharge-side communicating path 40B according to the respective embodiments are not necessary in Embodiment 4, therefore, the structure can be simplified and cost reduction can be achieved.

Next, a modification example of the above respective embodiments will be explained with reference to FIG. 14 and FIG. 15. FIG. 14 is a diagram for explaining a relation between the differential pressure and the oil feeding amount in the case where two oil feeding mount adjusting units 30 according to the above respective embodiments are connected in series, and FIG. 15 shows front views of valve elements for explaining an upstream-side valve element (a) and a downstream-side valve element (b) at the time of arranging two oil feeding amount adjusting units 30 in series.

The modification example to be explained below can be applied to any of the above Embodiments 1 to 4. In the present modification example, two oil feeding amount adjusting units 30 according to the respective Embodiments 1 to 4 are provided in series in the oil feeding passage 15B, thereby performing adjustment of the oil feeding amount with respect to the differential pressure more finely as shown in FIG. 14.

That is, an upstream-side oil feeding amount adjusting unit 30A and a downstream-side oil feeding amount adjusting unit 30B are provided in the oil feeding passage 15B in the present modification example. A valve element 31A in the upstream-side oil feeding amount adjusting unit 30A is provided with a first flow path 36A with a large flow path area and a second flow path 37A with a small flow path area as shown in a view (a) of FIG. 15. A valve element 31B in the downstream-side oil feeding amount adjusting unit 30B is provided with a first flow path 36B with a large flow path area and a second flow path 37B with a small flow path area as shown in a view (b) of FIG. 15.

The first flow path 36B of the valve element 31B is configured to have a larger flow path area than the first flow path 36A of the valve element 31A, and the second flow path 37B of the valve element 31B is configured to have a narrower flow path area than the second flow path 37A of the valve element 31A.

Next, a specific example in which the first flow paths 36A, 36B and the second flow paths 37A, 37B in respective valve elements are switched to change the oil feeding amount to bearings by operating the respective valve elements 31A and 31B in accordance with a differential pressure between the high pressure side and the low pressure side will be explained with reference to FIG. 14.

In FIG. 14, a curve A indicates variation of the oil feeding amount with respect to the differential pressure in a flow path combined so that the first flow path 36A of the valve element 31A and the first flow path 36B of the valve element 31B are allowed to open to the oil feeding passage 15B, a curve B indicates variation of the oil feeding amount with respect to a differential pressure in a flow path combined so that the second flow path 37A of the valve element 31A and the first flow path 36B of the valve element 31B are allowed to open to the oil feeding passage 15B, and a curve C indicates variation of the oil feeding amount with respect to a differential pressure in a flow path combined so that the second flow path 37A of the valve element 31A and the second flow path 37B of the valve element 31B are allowed to open to the oil feeding passage 15B.

Also in FIG. 14, the operation state performed when the differential pressure is lower than the predetermined value (first predetermined value) c1 is defined as the low-differential pressure operation, the operation state performed when the differential pressure is equal to or higher than the predetermined value c1 is defined as the standard operation, and the operation state performed when the differential pressure is equal to or higher than the second predetermined value c2 which is particularly higher than the predetermined value c1 is defined as the high load operation. Furthermore, in FIG. 14, a predetermined value (third predetermined value) between the predetermined values c1 and c2 is also set. These predetermined values c1, c2 and c3 are previously set in the controller 48.

At the time of the low-differential pressure operation where the differential pressure is lower than the predetermined value c1, the oil in the oil feeding passage 15B is allowed to flow through the combination of the first flow path 36A of the valve element 31A and the first flow path 36B of the valve element 31B as shown by the curve A, thereby securing a sufficient oil feeding amount even when the differential pressure is low and promoting lubrication and cooling of bearings, as a result, reliability of bearings can be improved.

In the case where the differential pressure is equal to or more than the predetermined value c1 and equal to or less than c2 to be under the standard operation condition which requires performance, when the differential pressure is equal to or more than the predetermined value c1 and less than c3, the oil is allowed to flow through the combination of the second flow path 37A of the valve element 31A and the first flow path 36B of the valve element 31B, thereby suppressing increase of the oil feeding amount as shown by the curve B of FIG. 14, therefore, heating of the suction refrigerant gas due to the high-temperature oil after cooling bearings can be reduced and agitation loss of oil sucked into the compression chamber can be also reduced, therefore, performance can be improved.

When the differential pressure is equal to or more than the predetermined value c3 and lower than c2, oil is allowed to flow through the combination of the second flow path 37A of the valve element 31A and the second flow path 37B of the valve element 31B, thereby further suppressing increase of the oil feeding amount even when the differential pressure is increased as shown by the curve C of FIG. 14. Accordingly, the heating of the suction refrigerant gas can be further suppressed even when the differential pressure is increased and agitation loss of oil sucked into the compression chamber can be also reduced, therefore, performance can be improved.

The bearing load is increased and the temperature of the compression gas is also increased at the time of the high load operation in which the differential pressure is equal to or more than the predetermined value c2, therefore, the oil in the oil feeding passage 15B is allowed to flow again as shown by the curve A through the combination of the first flow path 36A of the valve element 31A and the first flow path 36B of the valve element 31B for increasing the oil feeding amount to the bearings to increase the reliability and also for promoting cooling. Accordingly, the oil feeding amount is increased to increase the oil feeding amount to the bearings, and lubrication and cooling of the bearings are promoted, thereby improving reliability of the bearings.

As the two oil feeding amount adjusting units 30 are arranged in series as described above, the oil feeding amount can be finely adjusted with respect to the differential pressure (operation condition) as shown in FIG. 14 by operating the valve element 31A and 31B and switching combinations between the first flow paths 36A, 36B and the second flow paths 37A, 36B. In particular, the oil feeding amount can be adjusted so as to correspond to the operation condition in the standard operation condition which requires performance, therefore, it is particularly effective for improving the performance of the compressor.

Although the combination of the second flow path 37A and the first flow path 36B is adopted in the curve B, it is also possible to adopt a combination of the first flow path 36A and the second flow path 37B. Moreover, when the flow path areas of the second flow paths 37A and 37B are changed, it is possible to control the oil feeding amount more finely. Furthermore, arrangement is not limited to the arrangement of two oil feeding amount adjusting units 30 in series, and three or more oil feeding amount adjusting units 30 may be arranged in series as long as a plurality of oil feeding amount adjusting units are arranged.

FIG. 16 to FIG. 18 show examples of groove shapes 45 of the first flow paths 36, 36A and 36B and the second flow paths 37, 37A and 37B formed in the valve elements 31, 31A and 31B in the respective embodiments.

FIG. 16 is an enlarged view of a relevant part showing a first example of the groove shape 45, which is the example in which the groove shape 45 formed in the valve elements 31, 31A and 31B is an edge shape.

FIG. 17 is an enlarged view of a relevant part showing a second example of the groove shape 45, which is the example in which the groove shape 45 formed in the valve elements 31, 31A and 31B is an arc shape.

FIG. 18 is an enlarged view of a relevant part showing a third example of the groove shape 45, which is the example in which the groove shape 45 formed in the valve elements 31, 31A and 31B is a V-shape.

The groove shapes 45 of the first flow paths 36, 36A and 36B and the second flow paths 37, 37A and 37B are not limited to those shown in FIG. 16 to FIG. 18, and other shapes may be adopted.

The oil feeding amount adjusting unit 30 provided in the oil feeding passage 15B to the low-pressure side bearings 7A, 8A and 8B has been explained in the above respective embodiments, however, the same applies to the oil feeding amount adjusting unit 30 provided in the oil feeding passage 15C to the high-pressure side bearings 9A, 9B, 10A and 10B. That is, the present invention can be achieved in the same manner by providing the oil feeding amount adjusting unit 30 shown in the above-described respective embodiments in the middle of the oil feeding passage as long as there exists the oil feeding passage for feeding oil by the differential pressure to bearings which support the screw rotor.

As described above, according to respective embodiment of the present invention, the valve element having plural flow paths with different flow path areas is moved in accordance with the differential pressure between the high pressure side and the low pressure side, thereby switching the plural flow paths to adjust the oil feeding amount to be fed to the low-pressure side bearings, therefore, the oil feeding amount can be changed during operation, and a sufficient oil feeding amount necessary for bearings can be secured even when the differential pressure is low to promote lubrication and cooling of the bearings. Even when the differential pressure is increased under the standard operation condition which requires performance, it is possible to obtain an advantage that increase of the oil feeding amount more than necessary is suppressed to thereby suppress increase of the heating amount of the suction gas due to the high-temperature oil after cooling the bearings. Furthermore, the oil feeding amount to bearings is increased also at the time of the high load operation, thereby obtaining advantages that the reliability can be further increased and the cooling can be promoted.

According to respective embodiments of the present invention, the oil feeding amount can be adjusted during operation of the compressor as described above, therefore, the oil feeding amount can be suitably controlled in accordance with an operation state of the compressor, and it is possible to suppress increase of agitation loss of oil and heating loss of the suction gas by the oil caused by excessive oil feeding amount, as a result, the performance of the compressor can be improved.

Additionally, the spring is included in the mechanism for moving the valve element, and the valve element is configured so that the flow path area of oil is increased even when a problem occurs in the mechanism for moving the valve element such as a failure in the solenoid valve, thereby obtaining the screw compressor with high reliability.

The present invention is particularly suitable for a screw compressor which compresses a low GWP refrigerant such as R32. That is, in the screw compressor which compresses a high-temperature refrigerant such as R32, the oil is heated to be a higher temperature by the high-temperature refrigerant, and the high-temperature oil is discharged to the suction port's side after lubricating bearings, the suction refrigerant gas flowing in the suction port is heated to be a further higher temperature and heating loss is increased. In response to this, the oil feeding amount can be reduced to a suitable amount by adopting the present invention, therefore, the heating loss of the refrigerant gas sucked into the compression chamber can be suppressed and the reduction of performance due to the heating loss of the refrigerant gas can be suppressed.

In low-density refrigerants such as HFO1234yf and HFO1234ze, the speed has to be increased for obtaining a required refrigerating ability. Accordingly, a flow rate of the suction gas is increased and heat exchange with respect to the oil discharged to the suction port is further promoted, which heats the refrigerant gas. Also in response to this, the oil feeding amount can be reduced to a suitable amount by adopting the present invention, therefore, there is an advantage that reduction of performance due to the heating loss of the refrigerant gas can be suppressed.

The present invention is not limited to the above embodiments and various modification examples are included. For example, the examples in which the present invention is applied to the twin-screw compressor have been described in the above embodiments, however, the present invention can be also applied to a single-screw compressor and so on in the same manner.

The above embodiments are explained in detail for explaining the present invention easily to understand, and are not always limited to embodiments having all the explained components. Furthermore, part of components of a certain embodiment may be replaced with components of another embodiment. And components of a certain embodiment may be added to components of another embodiment. Furthermore, addition, deletion and replacement may be performed with respect to part of components of respective embodiments.

A program for realizing respective functions, information of respective determination values and so on may be placed in recording devices such as a memory, a hard disk and a SSD (Solid State Drive), or recording media such as an IC card, a SD card and a DVD.

REFERENCE SIGNS LIST

1: motor casing, 2: main casing, 2*a*: concave portion, 3: discharge casing, 3*a*: cylinder, 4: driving motor (electric motor), 4*a*: gas passage, 4*b*: air gap, 5: cylindrical bore, 6: suction port, 7A, 8A, 8B, 9A, 9B, 10A, 10B: bearings (7A, 8A, 8B: roller bearings (low-pressure side bearings), 9A, 9B: roller bearings (high-pressure side bearings), 10A, 10B: ball bearings (high-pressure side bearings), 11A: male rotor (screw rotor), 11B: female rotor (screw rotor), 12: oil separator, 14: oil reservoir, 15A, 15B, 15C: oil feeding passage, 16A, 16B: bearing chamber, 17: shielding plate, 18: suction port, 19: strainer, 20: stator, 21: motor rotor, 22: discharge port, 26: slide valve, 27: rod, 28: hydraulic piston, 29: coil spring, 30, 30A, 30B: oil feeding amount adjusting unit, 31, 31A, 31B: valve element, 32: valve element left surface, 33: valve element right surface, 34: spring, 35: cylinder, 36, 36A, 36B: first flow path, 37, 37A, 37B: second flow path, 38A, 38B: solenoid valve, 39A, 39B: communicating hole, 40A: suction-side communicating path, 40B: discharge-side communicating path, 40C: communicating path, 42: clearance (leak-out means), 43A, 43B, 43C: drilled holes (oil passages), 44: space, 45: groove shape, 46: suction pressure measuring device, 47: discharge pressure measuring device, 48: controller, 49: oil groove, 51: terminal box, 52: power supply terminal, 53: cable, 64: suction pipe, 65: fixing flange, 66: discharge pipe, 100: screw compressor

The invention claimed is:

1. A screw compressor having a screw rotor, an electric motor for driving the screw rotor, bearings supporting the screw rotor and a casing housing the screw rotor, electric motor and bearings, comprising:

an oil feeding passage formed in the casing for feeding oil on a high pressure side to the bearings by a differential pressure between the high pressure side and a low pressure side; and an oil feeding amount adjusting unit disposed within the oil feeding passage, wherein the oil feeding amount adjusting unit includes a cylinder and a valve element configured to reciprocate freely inside the cylinder, wherein the valve element has different outer diameters providing different plural flow paths around an outer surface of the valve element with different flow path areas, and wherein the valve element is configured to move in accordance with the differential pressure between the high pressure side and the low pressure side thereby switching between the plural flow paths to adjust an oil feeding amount to be fed to the bearings.

2. The screw compressor according to claim 1, further comprising:

a suction pressure measuring device detecting a suction pressure in the screw compressor; and a discharge pressure measuring device detecting a discharge pressure, wherein the plural flow paths are switched by operating the valve element in accordance with a differential pressure between the suction pressure measured by the suction pressure measuring device and the discharge pressure measured by the discharge pressure measuring device.

3. The screw compressor according to claim 1, wherein the plural flow paths provided in the valve element includes a first flow path and a second flow path with a smaller flow path area than the a flow path area of the first flow path.

4. The screw compressor according to claim 3, further comprising:

a discharge-side communicating path for introducing and giving a discharge side pressure of the compressor to one side surface of the valve element; and a suction-side communicating path for introducing and giving a suction side pressure of the compressor to one side surface of the valve element, wherein the first flow path and the second flow path formed in the valve element are switched by moving the valve element by opening/closing the respective communicating paths to give the discharge side pressure or the suction side pressure to one side surface of the valve element.

5. The screw compressor according to claim 4,
wherein the suction side pressure is constantly applied to the other side surface of the valve element, and
a spring is provided, which biases the valve element from the other side to one side.

6. The screw compressor according to claim 4,
wherein the discharge side pressure is constantly applied to the other side surface of the valve element, and
a spring is provided, which biases the valve element from one side to the other side.

7. The screw compressor according to claim 6,
wherein oil passages for allowing the other side surface of the valve element to communicate with the oil feeding passage are formed in the valve element, which constantly gives the discharge-side pressure to the other side surface of the valve element.

8. The screw compressor according to claim 4, further comprising:
a controller;
a first solenoid valve connected to the controller and configured to open or close the suction-side communicating path;
a second solenoid valve connected to the controller and configured to open or close the discharge-side communicating path;
a suction pressure measuring device connected to the controller and configured to detect a suction pressure in the compressor; and
a discharge pressure measuring device connected to the controller and configured to detect a discharge pressure,
wherein the controller is programmed to: open or close the first solenoid vale and the second solenoid valve based on a differential pressure between the suction pressure and the discharge pressure measured by the suction pressure measuring device and the discharge pressure measuring device to move the valve element thereby switching between the first flow path and the second flow of the valve element.

9. The screw compressor according to claim 8,
wherein the controller is programmed to: close the first solenoid valve and the second solenoid valve a power supply is cut off, and
a spring is provided, which biases and moves the valve element so that oil is fed to the bearings through the first flow path with the large flow path area when the power supply to the both solenoid valves is cut off and the solenoid valves are in a closed state.

10. The screw compressor according to claim 1,
wherein plural oil feeding amount adjusting units provided in the middle of the oil feeding passage are arranged in series in the oil feeding passage.

11. The screw compressor according to claim 1,
wherein the bearings include a low-pressure side bearing supporting the screw rotor on the low pressure side and
a high-pressure side bearing supporting the screw rotor on the high pressure side, and
the oil feeding amount adjusting unit is provided in the middle of the oil feeding passage for feeding high-pressure side oil to the low-pressure side bearing by a differential pressure.

12. A screw compressor having a screw rotor, an electric motor for driving the screw rotor, bearings supporting the screw rotor and a casing housing the screw rotor, the electric motor and bearings, comprising:
an oil feeding passage formed in the casing for feeding oil on a high pressure side to the bearings by a differential pressure between the high pressure side and a low pressure side; and
at least one oil feeding amount adjusting unit of disposed within the oil feeding passage,
wherein the oil feeding amount adjusting unit includes a cylinder and a valve element configured to reciprocate freely inside the cylinder,
wherein the valve element has different outer diameters providing a first flow path around an outer surface of the valve element and a second flow path around the outer surface of the valve element,
wherein the second flow path has a smaller flow path area than a flow path area of the first flow path,
wherein the at least one oil feeding amount adjusting unit further includes:
a suction-side communicating path introducing and giving a suction side pressure of the compressor to one side surface of the valve element,
a solenoid valve opening/closing the suction-side communicating path, and
a leak-out means provided in the valve element for allowing oil in the oil feeding passage to leak out on one side surface of the valve element, and
wherein the valve element is configured to move by opening/closing the solenoid valve in accordance with the differential pressure between the high pressure side and the low pressure side.

13. The screw compressor according to claim 12,
wherein plural oil feeding amount adjusting units provided in the middle of the oil feeding passage are arranged in series in the oil feeding passage.

14. The screw compressor according to claim 12,
wherein the bearings include a low-pressure side bearing supporting the screw rotor on the low pressure side and a high-pressure side bearing supporting the screw rotor on the high pressure side, and
the at least one oil feeding amount adjusting unit is provided in the middle of the oil feeding passage for feeding high-pressure side oil to the low-pressure side bearing by a differential pressure.

* * * * *